US011545751B2

(12) United States Patent
Yong et al.

(10) Patent No.: US 11,545,751 B2
(45) Date of Patent: Jan. 3, 2023

(54) ULTRA-WIDEBAND ANTENNA FOR REVERSIBLE ELECTRONIC DEVICE

(71) Applicant: Shanghai Amphenol Airwave Communication Electronics Co., Ltd, Shanghai (CN)

(72) Inventors: Checkchin Yong, Shanghai (CN); Hongliang Gu, Shanghai (CN); Jin Shang, Shanghai (CN)

(73) Assignee: Shanghai Amphenol Airwave Communication Electronics Co., Ltd, Shanghai (CN)

( * ) Notice: Subject to any disclaimer, the term of this patent is extended or adjusted under 35 U.S.C. 154(b) by 30 days.

(21) Appl. No.: 17/219,917

(22) Filed: Apr. 1, 2021

(65) Prior Publication Data

US 2022/0052451 A1 Feb. 17, 2022

(30) Foreign Application Priority Data

Aug. 14, 2020 (CN) ..... 202010820366.9

(51) Int. Cl.
*H01Q 5/25* (2015.01)
*H01Q 1/22* (2006.01)
*H01Q 13/10* (2006.01)

(52) U.S. Cl.
CPC ..... *H01Q 5/25* (2015.01); *H01Q 1/2258* (2013.01); *H01Q 13/10* (2013.01)

(58) Field of Classification Search
CPC ..... H01Q 5/25; H01Q 1/2258; H01Q 13/10; H01Q 1/521; H01Q 9/285; H01Q 21/28; H01Q 1/241; H01Q 1/36; H01Q 1/50; H01Q 5/307; H01Q 9/16
See application file for complete search history.

(56) References Cited

U.S. PATENT DOCUMENTS

2015/0303568 A1* 10/2015 Yarga ..... H01Q 5/321 343/722

FOREIGN PATENT DOCUMENTS

CN 106058429 A * 10/2016 ..... G06F 1/1616
GB 2404791 A * 2/2005 ..... H01Q 1/243

* cited by examiner

*Primary Examiner* — Andrea Lindgren Baltzell

(57) ABSTRACT

The present disclosure provides an ultra-wideband antenna for a reversible electronic device in a narrow space including: an upper half and a lower half; a hinge connected with the upper half and the lower half; a first RF signal source, loaded on the hinge; an electrical connection structure, placed on one side of the first RF signal source and electrically connected with the upper half and the lower half; a gapped groove, extending inwardly to the electrical connection structure along the outer side of the upper half and the outer side of the lower half; the hinge is spanned on the gapped groove; the hinge excites the gapped groove to form a first ultra-wideband antenna. While realizing the ultra-wideband antennas, it can also integrate with other multiple antennas, and their isolations are better than −10 dB, which basically meets the antenna performance requirements.

33 Claims, 29 Drawing Sheets

ULTRA-WIDEBAND ANTENNA FOR REVERSIBLE ELECTRONIC DEVICE

CROSS REFERENCE TO RELATED APPLICATION

This application claims the benefits of priority to Chinese Patent Application No. CN 2020108203669, entitled "Ultra-Wideband Antenna for Reversible Electronic Device", filed with CNIPA on Aug. 14, 2020, the contents of which are incorporated herein by reference in its entirety.

BACKGROUND

Field of Disclosure

The present disclosure belongs to the field of antenna design, in particular, to an ultra-wideband antenna for a reversible electronic device.

Description of Related Arts

As the information age progresses, various mobile electronic products have become an indispensable part of daily life. Notebook computers are popular with people for their lightness, portability, and powerful functions. To pursue a better appearance, higher structural strength and better heat dissipation performance, more and more notebook computers are designed with metal bodies. The design of antenna is challenged by the metal body. At present, mainstream notebook computers on the market use Wireless Local Area Network (WLAN) for information interaction. The high-end models will add Wireless Wide Area Network (WWAN) antennas to provide a more convenient Internet experience. Taking into account the rapid development of 5G communications, the antenna configuration and number of notebook computers will change significantly in the future. The addition of 5G (FR1) frequency band puts forward higher requirements for notebook computer antenna design. The isolation problem between multiple antennas is also a challenge faced by various mobile terminal devices in antenna design.

FIGS. 1 and 2 are simplified diagrams of two of the most common notebook computers on the market. Traditional notebook computer antennas may be placed in the areas shown in FIGS. 1 and 2: 1) upper area 2 above the screen 1; 2) hinge area 4 between the screen 1 and the keyboard 3; 3) area of two sides of the keyboard 5 and edge area of the lower side of the keyboard 6; Due to the industrial design (ID) requirements of narrow bezel and high screen-to-body ratio, the space above screen 1 is squeezed, which cannot meet the requirement of clearance for WWAN antenna design. The hinge area 4 between the screen 1 and the keyboard 3 is constrained by the specific environment, thus the isolation between antennas is poor. Generally, the hinge area 4 is used for designing WLAN antennas. Placing antennas on area of two sides of the keyboard and edge area of the lower side of the keyboard 6 will occupy the space of the mainboard or the speaker sound cavity. For WWAN antennas, a clearance of about 90 mm*10 mm is generally required to ensure antenna performance. In particular, when the notebook computer has a metal body, the traditional antenna design has to open a window in the metal body to ensure the antenna clearance, which will affect the ID design. Considering the impact of human hands and legs on the antenna performance and the risk of Specific Absorption Rate (SAR) in a real use scenario (as shown in FIG. 3), when the antenna is located on two sides of the keyboard, the antenna performance would be greatly sacrificed. In addition, the isolation problem between multiple antennas is also a difficult problem in antenna design. Generally, the method of isolation stub or neutralization line is used to solve the above problem. However, the isolation stub and neutralization line can only achieve adjustment in a narrow frequency band, and will affect the antenna performance.

SUMMARY

The present disclosure provides an ultra-wideband antenna for a reversible electronic device, to solve the problem that the design of the ultra-wideband antenna is limited due to the ID design requirements of the narrow bezel and high screen-to-body ratio of the reversible electronic device.

The present disclosure provides an ultra-wideband antenna for a reversible electronic device, the ultra-wideband antenna includes at least:

an upper half and a lower half;

a hinge having a first end and a second end opposite to the first end; the hinge is connected with the upper half through the first end, and is connected with the lower half through the second end;

a first RF signal source, loaded on the hinge;

an electrical connection structure, placed on one side of the first RF signal source and electrically connected with the upper half and the lower half;

a gapped groove, extending inwardly to the electrical connection structure along an outer side of the upper half and an outer side of the lower half; the hinge is spanned on the gapped groove;

the hinge excites the gapped groove to form a first ultra-wideband antenna.

Optionally, the first RF signal source is connected with the first end of the hinge; the first end of the hinge is non-electrically connected with the upper half; the second end of the hinge is electrically connected with the lower half.

Optionally, at least one of the first RF signal source and the electrical connection structure is connected with an interior of the hinge; the first end of the hinge is electrically connected with the upper half; the second end of the hinge is electrically connected with the lower half.

Optionally, the connection positions of the hinge with the upper half and the lower half are adjustable, and/or the size and shape of the hinge is adjustable.

Optionally, the electrical connection structure is a circumferentially enclosed hollow metal layer, and the hollow metal layer internally wraps a communication signal line between the upper half and the lower half.

Optionally, the electrical connection structure is in a form of flexible printed circuit (FPC) integrated with a communication signal line and a ground.

Optionally, the ultra-wideband antenna for the reversible electronic device further includes: a first type of first excitation unit; the first type of first excitation unit is placed in a slot formed by the upper half, the lower half, the hinge and the electrical connection structure; the first type of first excitation unit excites the slot to form a second ultra-wideband antenna, and an excitation mode of the first type of first excitation unit is direct excitation or coupling excitation.

Optionally, the ultra-wideband antenna for a reversible electronic device further includes a balun structure connecting to the first type of first excitation unit.

Optionally, the ultra-wideband antenna for the reversible electronic device further includes a second type of first excitation unit, the second type of first excitation unit includes an antenna trace, an excitation component, and a signal source; the second type of first excitation unit is placed in a slot formed by the upper half, the lower half, the hinge and the electrical connection structure; the second type of first excitation unit excites the slot to form a second ultra-wideband antenna, and an excitation mode of the second type of first excitation unit is coupling excitation.

Optionally, the ultra-wideband antenna for the reversible electronic device further includes: a third type of first excitation unit; the third type of first excitation unit includes an excitation component, and a signal source; the third type of first excitation unit is placed in a slot formed by the upper half, the lower half, the hinge and the electrical connection structure; the third type of first excitation unit excites the slot to form a second ultra-wideband antenna, and an excitation mode of the third type of first excitation unit is direct excitation.

Optionally, the ultra-wideband antenna for the reversible electronic device further includes a dipole antenna, the dipole antenna is placed in the slot and is placed horizontally along a length of the slot, and the first/second type of first excitation unit is placed perpendicularly and orthogonally with the dipole antenna.

Optionally, the excitation mode of the dipole antenna is coupling excitation; the dipole antenna includes a signal source, an excitation component connected with the signal source of the dipole antenna, and a dipole antenna trace; the excitation component couples a signal of the signal source of the dipole antenna to the dipole antenna trace, such that the dipole antenna trace works in a dipole-like antenna mode.

Optionally, the ultra-wideband antenna for a reversible electronic device further includes a monopole antenna, the monopole antenna is placed in a slot formed by the upper half, the lower half, the hinge and the electrical connection structure.

Optionally, the ultra-wideband antenna for a reversible electronic device further includes an antenna electronic switch having an RF input end, a first RF output end and a second RF output end; the RF input end of the antenna electronic switch is connected with the first RF signal source, and the first RF output end and the second RF output end are connected with the monopole antenna and the hinge, respectively.

Optionally, the ultra-wideband antenna for a reversible electronic device further includes a sensor, the sensor detects a rotation mode of the reversible electronic device, such that the antenna electronic switch switches an RF signal path to the monopole antenna or the hinge based on the rotation mode detected by the sensor.

Optionally, the ultra-wideband antenna for a reversible electronic device further includes a received signal strength indicator, the received signal strength indicator detects antenna signal strength at different RF signal path, such that the antenna electronic switch selects a signal routing to the monopole antenna or the hinge based on better signal strength detected by the received signal strength indicator.

Optionally, an antenna bracket is provided between the upper half and the lower half, and the electrical connection structure is a metal trace provided on the antenna bracket; a part of the metal trace is a circumferentially enclosed hollow metal layer, and a rest of the metal trace is a solid metal trace, and the hollow metal layer internally wraps a communication signal line between the upper half and the lower half; or, the metal trace is a circumferentially enclosed hollow metal layer, and the hollow metal layer internally wraps a communication signal line between the upper half and the lower half.

Optionally, an antenna bracket is provided between the upper half and the lower half, and the electrical connection structure is a metal trace provided on the antenna bracket; the metal trace includes a long side extending in a horizontal direction and a short side extending in a vertical direction; the long side is electrically connected with the lower half, and the short side is electrically connected with the upper half; at least one antenna isolation ground structure is provided in the vertical direction; one end of the antenna isolation ground structure is electrically connected with the long side of the metal trace, and the other end of the antenna isolation ground structure is electrically connected with the upper half; at least two antenna slits are formed between the adjacent short side of the metal trace and the antenna isolation ground structure and between adjacent antenna isolation ground structures; a second excitation unit which uses direct excitation or coupling excitation is placed in each of the antenna slits; the second excitation unit excites the antenna slits to form at least two slit antennas.

Optionally, the long side, the short side, and the antenna isolation ground structure are circumferentially enclosed hollow metal layers; the hollow metal layer internally wraps the communication signal line between the upper half and the lower half; or, the communication signal line between the upper half and the lower half is wired along part or all of a surface of the long side, the short side, and/or the antenna isolation ground structure.

Optionally, the communication signal line includes a ground wire and a core wire; the long side, the short side and the antenna isolation ground structure at corresponding positions of a wiring of the communication signal line are the ground wires.

Optionally, at least one antenna isolation ground structure is provided between adjacent antenna slits, to improve isolation between the slit antennas.

Optionally, the long side of the metal trace is an electrically continuous long side or a non-electrically continuous long side.

Optionally, an opening is provided on the antenna bracket, and the metal trace and the antenna isolation ground structure are attached to an inner wall of the opening; the antenna isolation ground structure attached to the inner wall of the opening forms a three-dimensional antenna isolation ground structure, and the metal trace attached to the inner wall of the opening forms a two-dimensional or three-dimensional metal trace.

Optionally, the ultra-wideband antenna for a reversible electronic device further includes a slit antenna; the slit antenna includes a long slit formed between the long side extending in the horizontal direction and the lower half, and a third excitation unit placed in the long slit; the third excitation unit excites the long slit to form the slit antenna; an excitation mode of the third excitation unit is direct excitation or coupling excitation.

Optionally, the ultra-wideband antenna for a reversible electronic device further includes at least one metal connecting wire and at least two third excitation units; the metal connecting wire and the third excitation units are placed between the upper half and the lower half; one end of the metal connecting wire is connected with the upper half, and the other end of the metal connecting wire is connected with the lower half; all the metal connecting wires divide the long slit into at least two slits; at least two third excitation units are placed in each of the slits, respectively; the third excitation unit excites the slit where it is located to form a slit antenna.

Optionally, the ultra-wideband antenna for a reversible electronic device further includes at least one metal connecting wire and a fourth excitation unit; the metal connecting wire and the fourth excitation unit are placed between the upper half and the lower half; one end of the metal connecting wire is connected with the upper half, and the other end of the metal connecting wire is connected with the lower half; at least one slit is formed between the adjacent metal connecting wire and the electrical connection structure, and between two adjacent metal connecting wires; the fourth excitation unit is placed in each of the slits; the fourth excitation unit excites the slit where it is located to form a slit antenna.

Optionally, the first type of first excitation unit or the dipole antenna trace of the dipole antenna serves as a sensing pad of a distance sensor.

Optionally, the antenna trace of the second type of first excitation unit or the dipole antenna trace of the dipole antenna serves as a sensing pad of a distance sensor.

Optionally, at least one of an excitation component of the second excitation unit and an excitation component of the third excitation unit serves as a sensing pad of a distance sensor.

Optionally, an excitation component of the fourth excitation unit serves as a sensing pad of a distance sensor.

Optionally, the monopole antenna serves as a sensing pad of a distance sensor.

Optionally, the third type of first excitation unit serves as a sensing pad of a distance sensor.

As described above, the ultra-wideband antenna for a reversible electronic device of the present disclosure skillfully uses the structural characteristics of the hinge area of the reversible electronic device without additional slotting or slitting. By setting a gapped groove, the design of the ultra-wideband antenna in a narrow space is realized. The working frequency bands cover all 2G, 3G, 4G, 5G (FR1), BT, Navigation, and Wi-Fi communication frequency bands. In addition, while realizing the design of ultra-wideband antennas, the design of multiple antennas is allowed to be further optimized, and the isolation between multiple antennas is better than −10 dB, which basically satisfies the performance target of the antennas.

BRIEF DESCRIPTION OF THE DRAWINGS

FIGS. 6 and 7 are simulated efficiency comparison diagram and simulated SAR value comparison diagram when the ultra-wideband antenna for a reversible electronic device of the present disclosure is designed as a WWAN antenna on a notebook computer and when the WWAN antenna is placed on one side of the keyboard in a traditional notebook computer.

FIG. 30 shows an exploded schematic view of the hinge area of a notebook computer. FIGS. 33 and 34 show schematic diagrams of an ultra-wideband antenna for a reversible electronic device according to embodiment 5 of the present disclosure. FIG. 35 shows a schematic diagram of an antenna isolation ground structure on the antenna bracket.

DESCRIPTION OF REFERENCE NUMERALS

Figure 1:
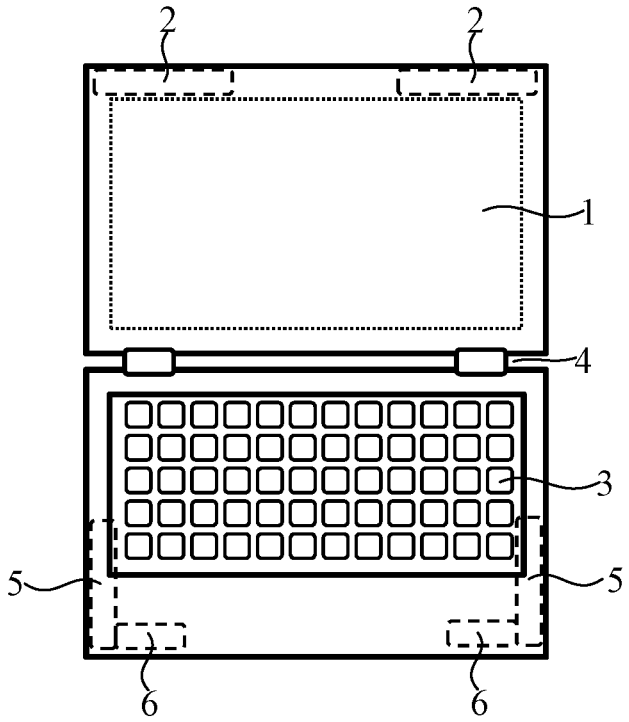
FIGS. 1 and 2 show schematic diagrams of the structure of a traditional notebook computer and the position of the antenna.
Figure 2:
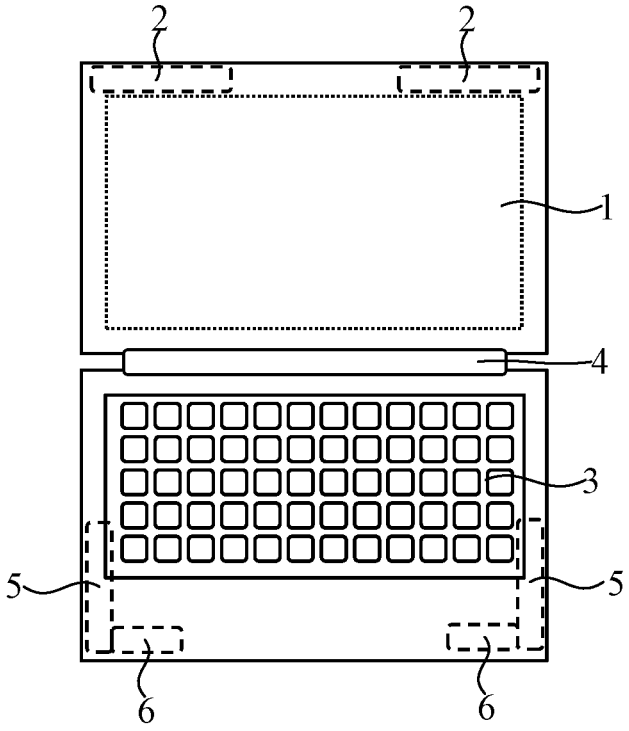
Figure 3:
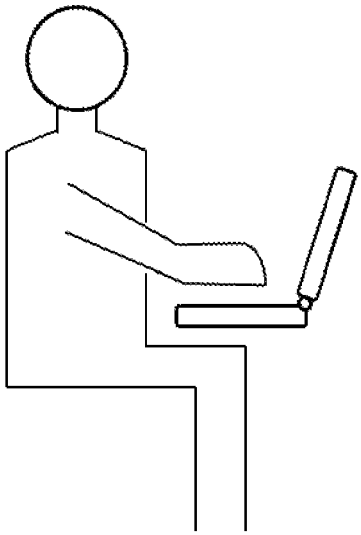
FIG. 3 shows a schematic diagram of the positional relationship between a traditional notebook computer and the human body during the use of the notebook computer.

1 Screen
2 Upper area
3 Keyboard
4 Hinge area
5 Two sides of the keyboard
6 Lower side of the keyboard
10 Upper half
11 Lower half
12 Hinge
13 First RF signal source
14 Electrical connection structure
15 Gapped groove
16 Hollow metal layer
17 Communication signal line
18 First type of first excitation unit
19 Signal source of the first type of first excitation unit
18*a* Second type of first excitation unit
18*b* Antenna trace of the second type of first excitation unit
18*c* Excitation component of the second type of first excitation unit
18*d* Signal source of the second type of first excitation unit
18*e* Third type of first excitation unit
18*f* Excitation component of the third type of first excitation unit
18*g* Signal source of the third type of first excitation unit
20 Slot
21 Dipole antenna
22 Signal source of the dipole antenna
23 Excitation component of the dipole antenna
24 Dipole antenna trace
25 Antenna bracket
26 Metal trace
27 Long side
28 Short side
29 Long slit
30 Antenna isolation ground structure
31 Antenna slit
32 Second excitation unit
33 Insulating medium
34 Hinge area
35 Hinge housing
36 Third excitation unit
37 Fourth excitation unit
38 Metal connecting wire
39 Antenna electronic switch
40 Monopole antenna
41 BALUN structure
A Dotted box

DETAILED DESCRIPTION OF THE PREFERRED EMBODIMENTS

The embodiments of the present disclosure will be described below. Those skilled in the art can easily understand other advantages and effects of the present disclosure according to contents disclosed by the specification. The present disclosure can also be implemented or applied through other different exemplary embodiments. Various modifications or changes can also be made to all details in the specification based on different points of view and applications without departing from the spirit of the present disclosure.

It should be noted that an expression of a singular form includes an expression of a plural form unless otherwise indicated. For example, even though the communication signal line or the ground integrated into the FPC is referred to in the singular form, it is understood that a plurality of communication signal lines or the grounds may be integrated into the FPC.

Please refer to FIGS. 3 to 37. It needs to be stated that the drawings provided in the following embodiments are just used for schematically describing the basic concept of the present disclosure, thus only illustrating components only related to the present disclosure and are not drawn according to the numbers, shapes and sizes of components during actual implementation, the configuration, number and scale of each component during actual implementation thereof may be freely changed, and the component layout configuration thereof may be more complicated.

It should be noted that the electrical connection mode involved in this embodiment are all ideal. In actual applications, according to the structural features, the electrical connection function may be realized by using elastic piece, welding, screws, conductive fabric and the like. The "hollow" of the hollow metal layer includes air and an insulating medium.

Figure 4:
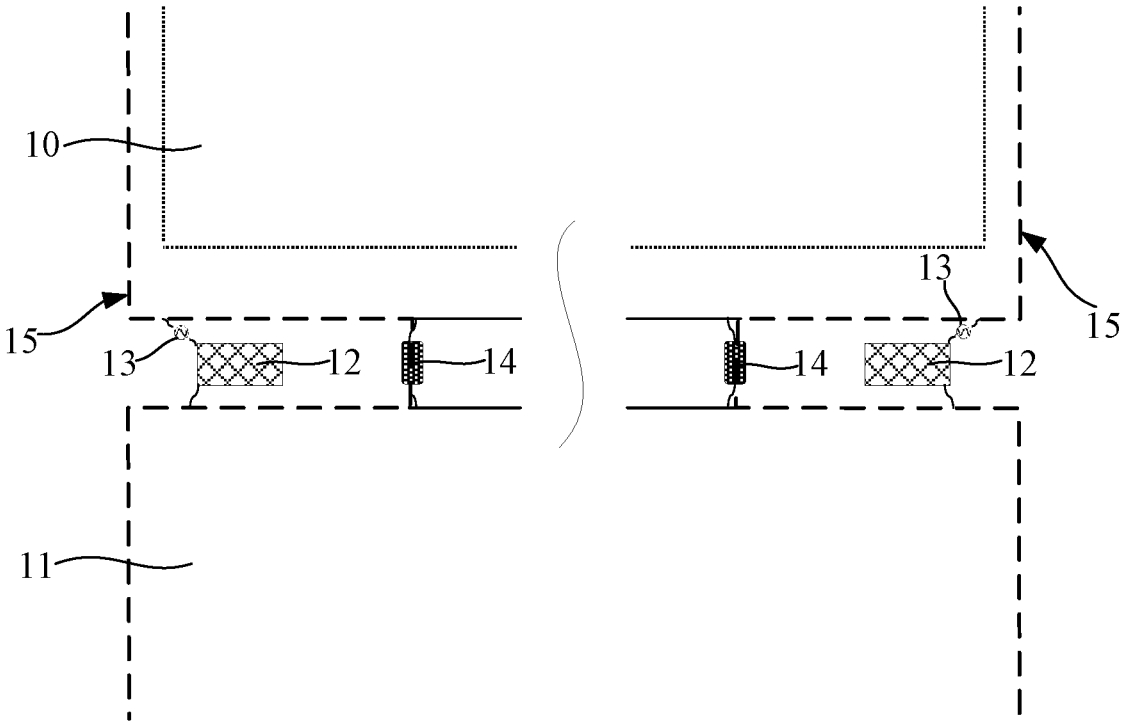
FIGS. 4 to 11 are schematic diagrams showing the ultra-wideband antenna for the reversible electronic device according to the present disclosure.

As shown in FIG. 4, the present disclosure provides an ultra-wideband antenna for a reversible electronic device, the ultra-wideband antenna includes at least:

an upper half 10 and a lower half 11;

a hinge 12 having a first end and a second end opposite to the first end, the hinge 12 is connected with the upper half through the first end, and the hinge 12 is connected with the lower half 11 through the second end;

a first RF signal source 13, loaded on the hinge 12;

an electrical connection structure 14, placed on one side of the first RF signal source 13 and electrically connected with the upper half 10 and the lower half 11;

a gapped groove 15, extending inwardly to the electrical connection structure 14 along the outer side of the upper half 10 and the outer side of the lower half 11 (As shown in the dotted gapped groove 15 in FIG. 4); the hinge 12 is spanned on the gapped groove 15;

the hinge 12 excites the gapped groove 15 to form a first ultra-wideband antenna.

It should be noted that the reversible electronic device is a unified whole in terms of electrical structure. For the convenience of description, the present disclosure divides the reversible electronic device into an upper half 10 and a lower half 11. The upper half 10 and the lower half 11 are connected through the hinge 12 to realize the relative rotation function between the two halves. The "upper" and "lower" mentioned in the upper half 10 and the lower half 11 only indicate the relative position between the two halves. If one is above the other, the above one can be called the upper half and the bottom one can be called the lower half, or, the above one can be called the lower half and the bottom one can be called the upper half. The reversible electronic device may be a reversible electronic product such as a notebook computer and an e-book. For example, when the reversible electronic device is a notebook computer, the upper half 10 may include components such as a display screen, a display back cover, and a camera assembly, and the lower half 11 may include components such as a keyboard, a mainboard, a front cover, and a back cover. In addition, the "end" described herein refers to an upper side or a lower side of a certain component. The "side" refers to a left side or a right side of a certain component. For example, the opposite first and second ends of the hinge 12 in FIG. 4 refer to the two sides of the hinge 12 close to the upper half 10 and the lower half 11; the electrical connection structure 14 being placed on a side of the first RF signal source 13 means that the electrical connection structure 14 is placed on the left side or right side of the first RF signal source 13.

As an example, the reversible electronic device may further include a hinge housing located between the upper half 10 and the lower half 11, for wrapping the hinge 12 and/or hiding the communication signal line of the electronic device.

Figure 6:
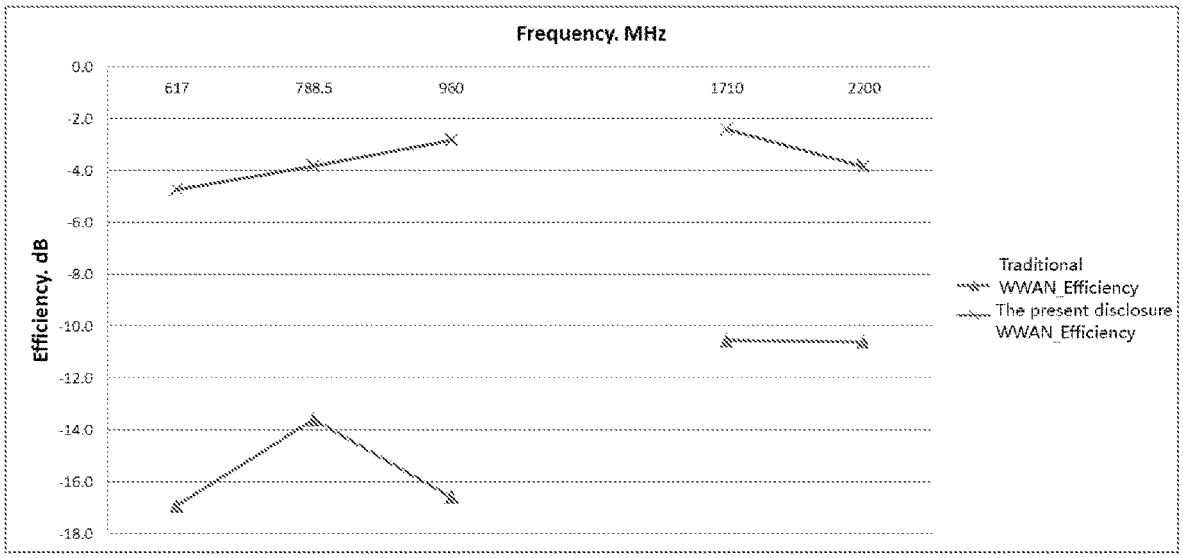
Figure 7:
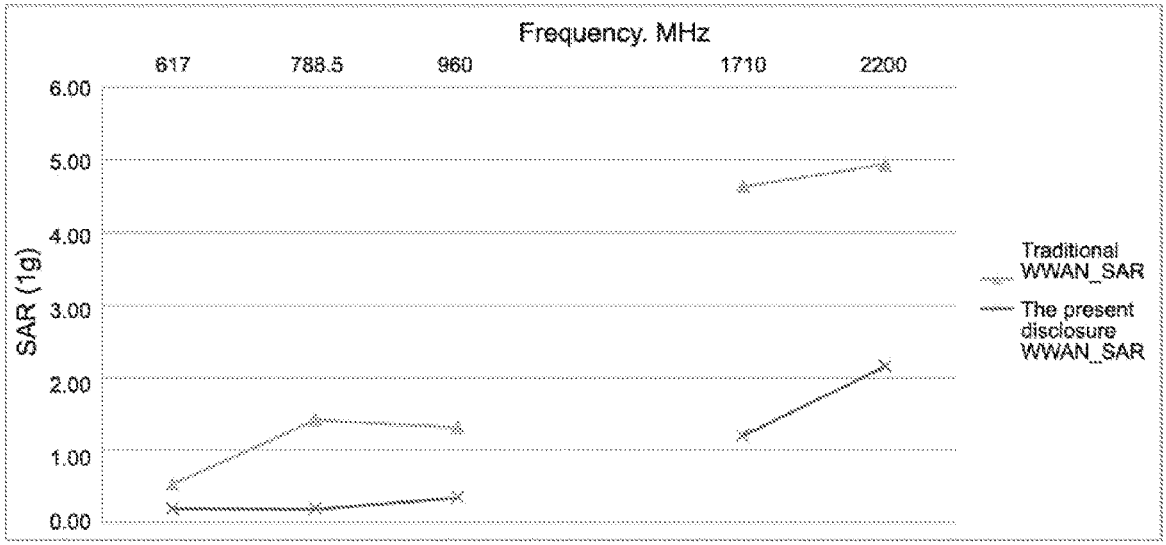

As an example, the reversible electronic device may be a notebook computer. By loading the first RF signal source 13 on the hinge 12, the hinge 12 excites the gapped groove 15, which is formed from the sides of the upper half 10 and the lower half 11 to the right/left to the area of the electrical connection structure 14, to form the first Ultra-wideband antenna. It should be noted that, as a necessary structural component of the notebook computer, the hinge 12 functions as a feed structure of the first ultra-wideband antenna while realizing the original flip function. In addition, the connection positions of the hinge 12 with the upper half 10 and the lower half 11, and/or the size and shape of the hinge 12 may be adjusted to optimize the first ultra-wideband antenna for antenna and mechanics tuning parameters. To facilitate understanding, FIG. 4 is a simplified structural diagram of the upper half 10 and the lower half 11 of the notebook computer when the two halves are opened at 180°, and the relative positions between the various parts are enlarged. When the notebook computer is opened, the gap between the upper half 10 and the lower half 11 is generally greater than 2 mm. The hinge 12 will partially overlap with the upper half 10 and the lower half 11 in the projection area. The overlapping part is generally used to connect and fix the hinge 12 with the upper half 10 and the lower half 11. The electrical connection structure 14 that electrically connects the upper half 10 and the lower half 11 divides the gap between the upper half 10 and the lower half 11. The electrical connection structure 14 ensures that the two first ultra-wideband antennas formed by the hinges 12 on the left and right sides do not interfere with each other, thus improving the isolation between the two antennas. In addition, the impedance of the first ultra-wideband antenna may be adjusted, and antennas of different wideband may be formed according to the relative positions of the electrical connection structure 14 and the excitation source signal. The hinge 12 has a certain electrical length. The hinge 12 may generate electromagnetic waves of corresponding wavelength by optimizing the structure. The notebook computer in this example has two hinges 12 (on the left side and the right side, respectively), to realize the design of two first ultra-wideband antennas. The frequency band of each of the first ultra-wideband antennas is 600 MHz-6000 MHz, with bandwidth covering all communication frequency bands including 2G, 3G, 4G, 5G (FR1), Navigation, BT and Wi-Fi. In addition, the working frequency band may be further expanded. FIGS. 6 and 7 are simulation efficiency comparison diagram and SAR value comparison diagram of a WWAN antenna placed on a side of the keyboard in the traditional notebook computer and a WWAN antenna in the notebook computer in this example. The distance between each antenna and the human body model is 5 mm, and the input power of the antenna is 23 dBm. Obviously, the WWAN antenna in this example has a lower SAR value than the traditional antenna while the efficiency is higher.

As shown in FIG. 4, as an example, the first RF signal source 13 is connected with the first end of the hinge 12. The first end of the hinge 12 is non-electrically connected with the upper half 10. The second end of the hinge 12 is electrically connected with the lower half 11. The electrical connection between the second end of the hinge 12 and the lower half 11 may be a single-point connection, a multi-point connection or a surface connection. It is common to use screws for multi-point connections, and add a matching circuit and a switch to the junction of the electrical connection. It should be noted that the first RF signal source 13 may be interchanged between the first end and the second end of the hinge 12. For example, when the first RF signal source 13 is connected with the second end of the hinge 12, the second end of the hinge 12 is non-electrically connected with the lower half 11, and the first end of the hinge 12 is electrically connected with the upper half 10.

Figure 5:
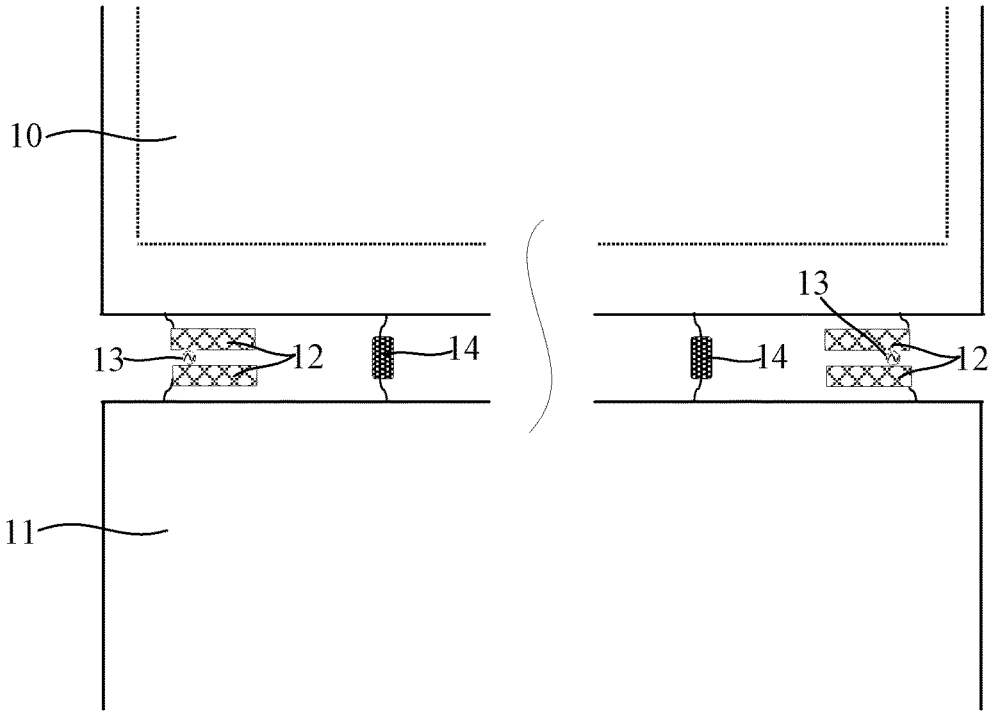

As shown in FIG. 5, as an example, the first RF signal source 13 is connected with the interior of the hinge 12. The first end of the hinge 12 is electrically connected with the upper half 10. The second end of the hinge 12 is electrically connected with the lower half 11. Preferably, the electrical connection is a single-point connection, a multi-point connection or a surface connection. A matching circuit and a switch may be added to the junction of the electrical connection.

Figure 8:
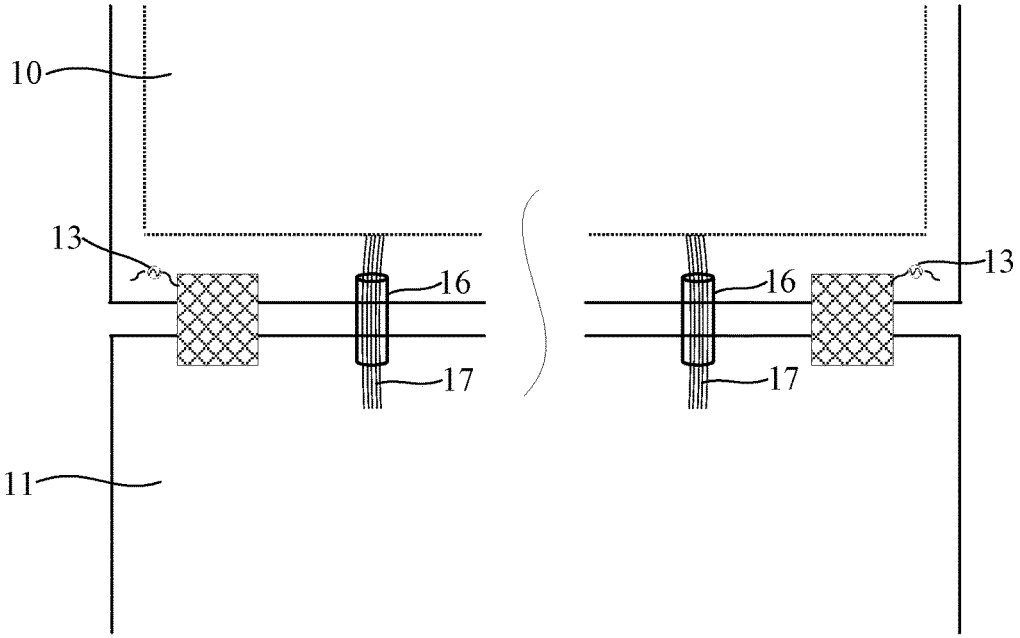

As shown in FIG. 8, as an example, the electrical connection structure is a circumferentially enclosed hollow metal layer 16. The hollow metal layer 16 internally wraps a communication signal line 17 between the upper half 10 and the lower half 11. The communication signal line 17 may be various signal lines in electronic equipment such as a screen signal line, a camera signal line, and an antenna feed coaxial line. The above hollow metal layer 16 can not only shield the high-frequency signal of the communication signal line 17, so as to reduce the mutual interference between the antenna and the device, but also facilitate the design of the communication signal line 17 and the electrical connection structure in the reversible electronic device. For example, the communication signal line 17 and the hollow metal layer 16 may have a design of Flex cable, which saves space and improves integration.

Figure 9:
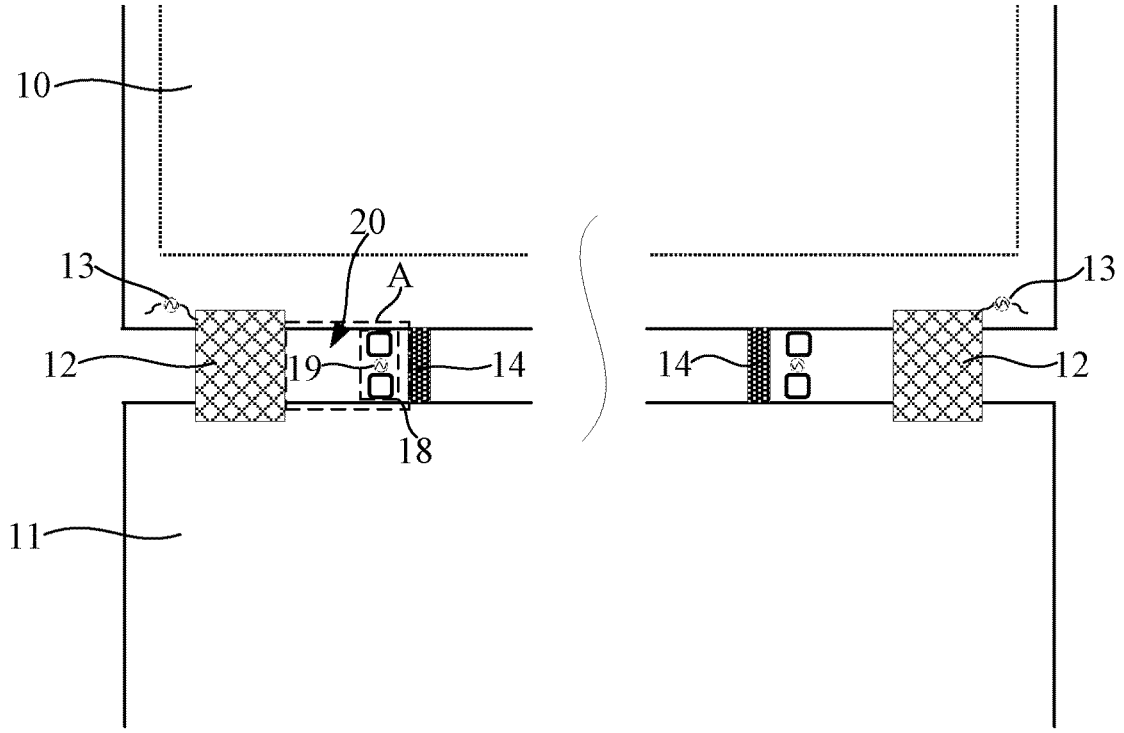
Figure 10:
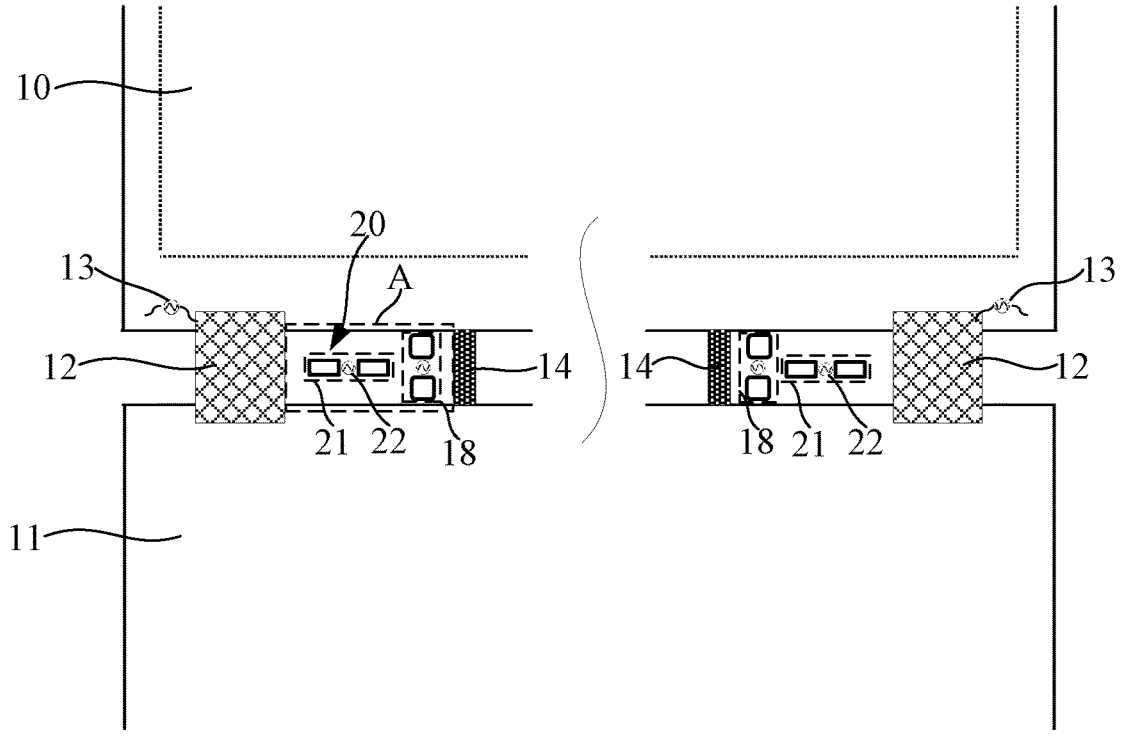
Figure 10A:
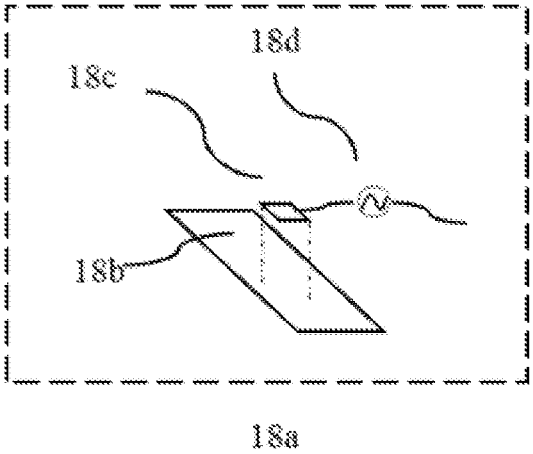
FIGS. 10A and 10C shows the second and third types of first excitation unit which can be the alternative antenna patterns to the first type of first excitation unit shown in FIG. 10.

As shown in FIG. 9, as an example, if the hinge area between the upper half 10 and the lower half 11 has a proper length, the ultra-wideband antenna for the reversible electronic device may further include: a first type of first excitation unit 18 (as shown in the dotted box A in FIG. 9). The first type of first excitation unit 18 is placed in a slot 20 formed by the upper half 10, the lower half 11, the hinge 12 and the electrical connection structure 14. The first type of first excitation unit 18 excites the slot 20 to form a second ultra-wideband antenna. The excitation mode of the first type of first excitation unit 18 may be direct excitation or coupling excitation (such as dipole excitation or monopole excitation). Alternatively, the first type of first excitation unit 18 may be replaced with a second type of first excitation unit 18*a* (shown in FIG. 10A). As shown in FIG. 10A, the second type of first excitation unit 18*a* includes: an antenna trace 18*b*, an excitation component 18*c*, and a signal source 18*d*. When the excitation component 18*c* and the antenna trace 18*b* are located in different spatial layers, in physical structure, the excitation component 18*c* and the projection part of the antenna trace 18*b* are non-electrically overlapped or separated by a certain distance. When the excitation component 18*c* and the antenna trace 18*b* are located in the same spatial layer, in physical structure, the excitation component 18*c* and the antenna trace 18*b* are partially separated by a certain distance. The antenna trace pattern may be straight or meandered or a combination thereof. In fact, there is another choice of first excitation unit, which is the third type of first excitation unit 18*e* as shown in FIG. 10C. The structure of the third type of first excitation unit 18*e* is rather simple compared with the first and second types of first excitation unit. The third type of first excitation unit 18*e* includes an excitation component 18*f* and a signal source 18*g*. The antenna structure is applied in a notebook computer, the frequency band of the second ultra-wideband antenna is 1400 MHz-6000 MHz, covering communication frequency bands including 2G, 3G, 4G, 5G (FR1), Navigation, BT and Wi-Fi. Therefore, four ultra-wideband antennas, including the two first ultra-wideband antennas and the two second ultra-wideband antennas, may be obtained in the area where the two hinges are located as shown in FIG. 9. According to requirements, the working frequency bands of the first ultra-wideband antennas and the second ultra-wideband antennas may be further expanded, so as to apply to UWB, Wi-Fi 6 and more antenna working frequency bands in the future.

Figure 12:
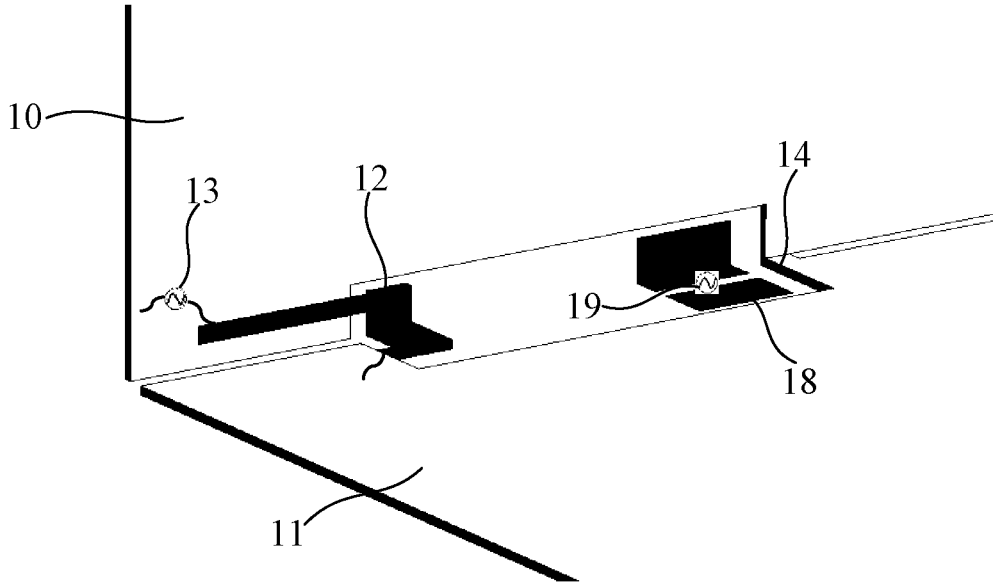
FIG. 12 shows a schematic diagram of an ultra-wideband antenna for a reversible electronic device according to embodiment 1 of the present disclosure.
Figure 12A:
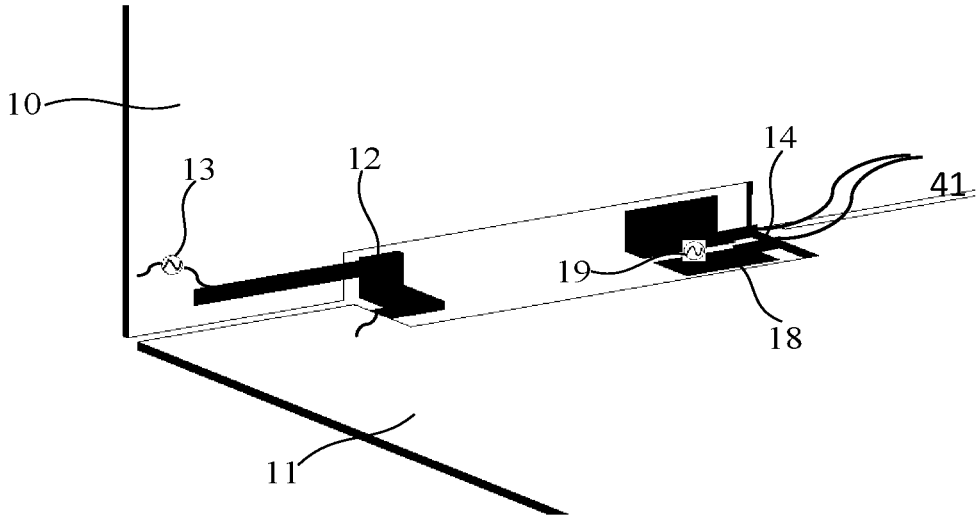
FIGS. 12A and 17A show schematic diagrams of an ultra-wideband antenna fora reversible electronic device including a balun structure connecting to the first type of first excitation unit.
Figure 17:
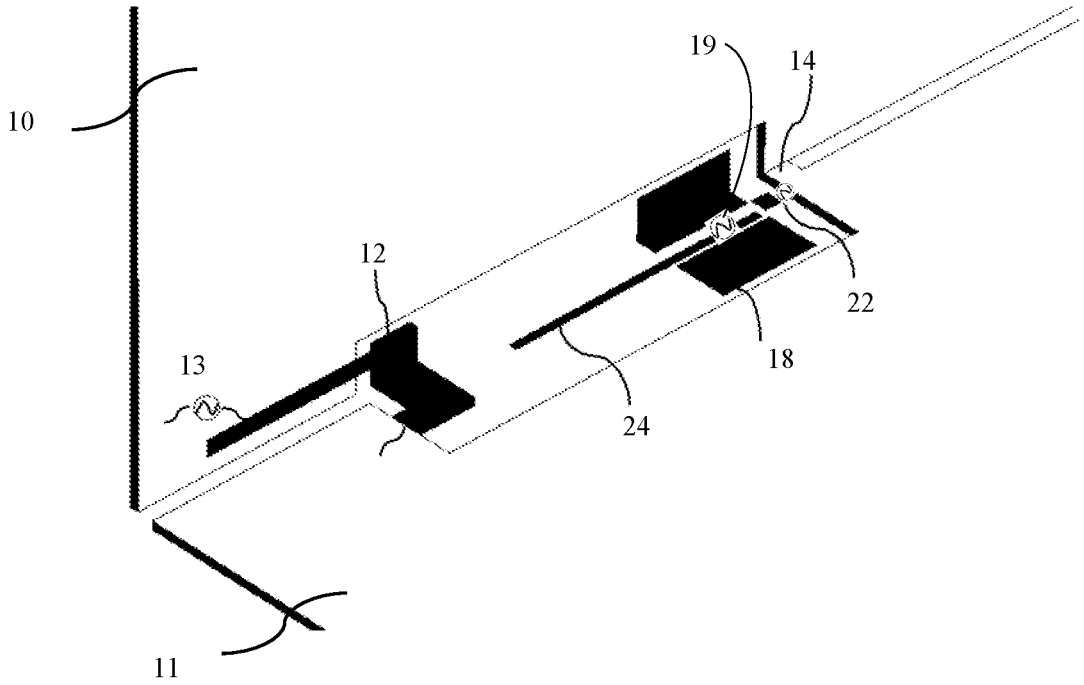
FIG. 17 shows a schematic diagram of an ultra-wideband antenna for a reversible electronic device according to embodiment 2 of the present disclosure.
Figure 17A:
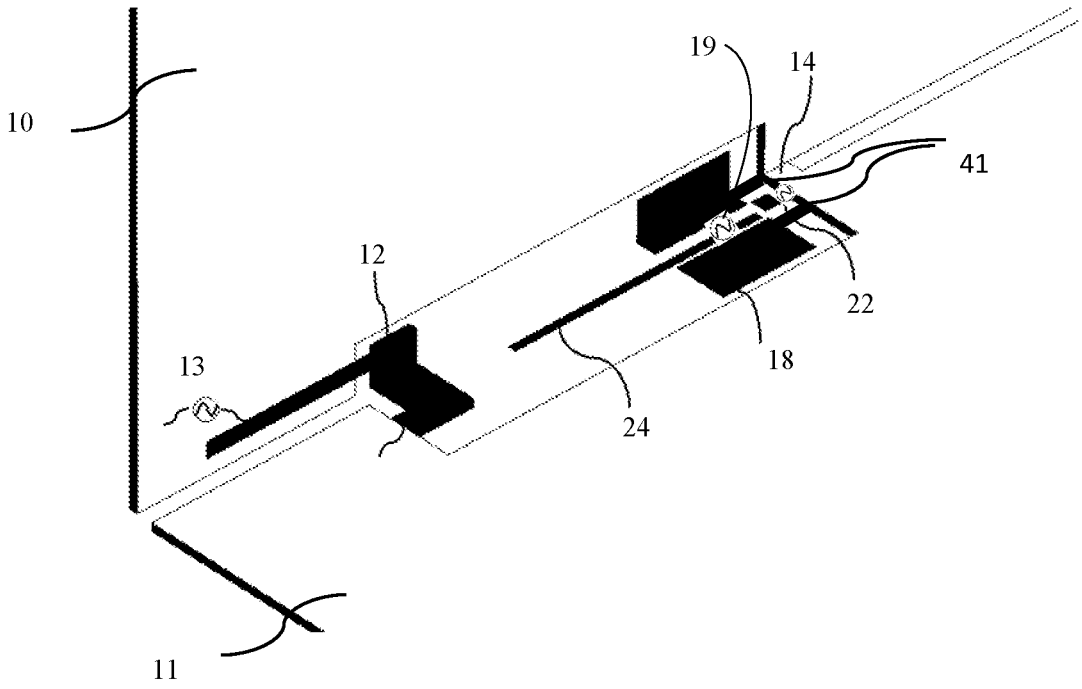

As shown in FIG. 12A and FIG. 17A, the ultra-wideband antenna for the reversible electronic device may further include a balun. The balun 41 is connected to the first type of first excitation unit 18 as a practical cable routing from RF circuit side to the first type of first excitation unit 18 and also to balance the unbalanced current distribution.

As an example, the first type of first excitation unit 18 or the antenna trace 18*b* of the second type of first excitation unit 18*a* may serve as a sensing pad of a distance sensor to realize the dual functions of an antenna and a sensor. Preferably, the external circuit of the distance sensor is integrated on the first type of first excitation unit 18 or the antenna trace 18*b* of the second type of first excitation unit 18*a*.

Figure 10B:
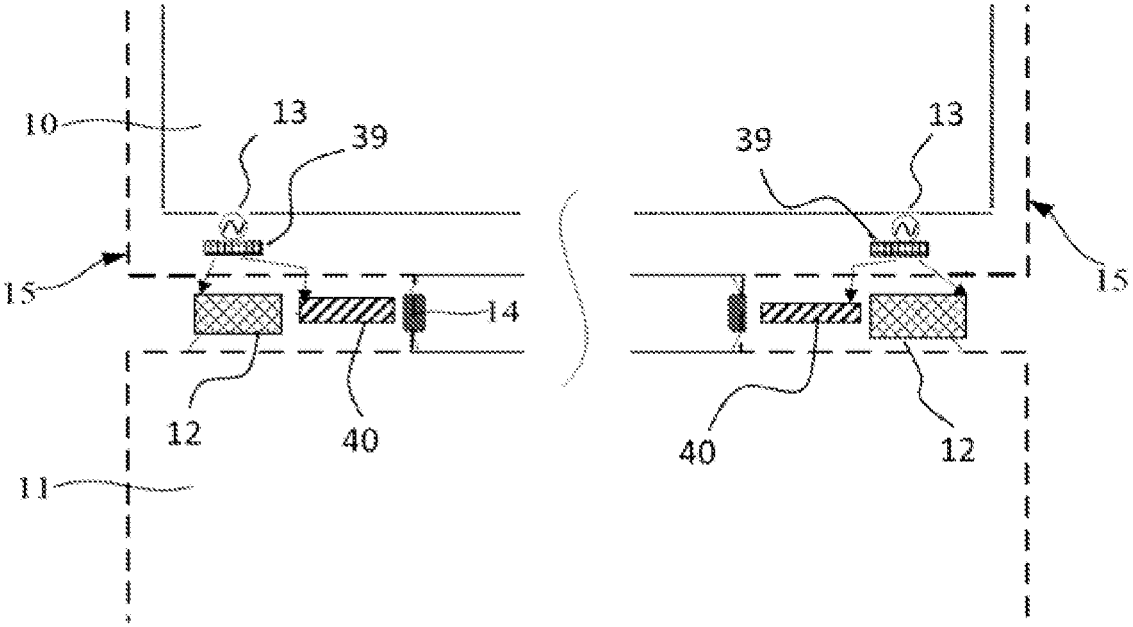
FIG. 10B shows a schematic diagram of an ultra-wideband antenna for a reversible electronic device according to the present disclosure.
Figure 10C:
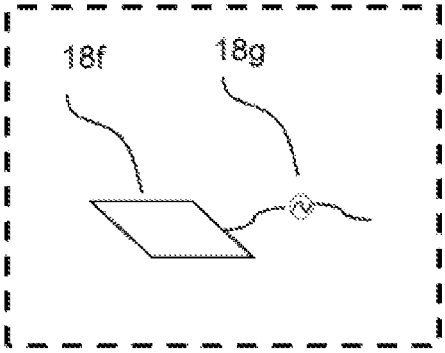

As shown in FIG. 10B, on the basis of FIG. 4, the ultra-wideband antenna for the reversible electronic device may further include: an antenna electronic switch 39, a monopole antenna 40, and a first RF signal source 13. The antenna electronic switch 39 includes an RF input end, a first RF output end and a second RF output end. The first RF signal source 13 is connected to an RF input end of the antenna electronic switch 39. The antenna trace pattern of the monopole antenna 40 may be straight or meandered or a combination thereof. The hinge 12 and the monopole antenna 40 are connected to a first RF output end and a second RF output end of the antenna electronic switch 39, respectively. Note that in order to make the antenna electronic switch 39 work, voltage supply and control logic such as General Purpose Input/Output (GPIO) are needed to be connected to the antenna electronic switch 39. However, as voltage supply and control logic are usual/normal setups and can be considered as black box setup, they are not shown here for simplicity reason. The antenna electronic switch 39 may be solid-state switch, electromechanical switch and so on. RF signal paths either routing to the monopole antenna 40 or the hinge 12 is based on the rotation mode of the reversible electronic device which can be detected by a sensor or based on better signal strength detected and selected by a Received Signal Strength Indicator (RSSI).

As shown in FIG. 10, as an example, on the basis of FIG. 9, the ultra-wideband antenna for the reversible electronic device may further include: a dipole antenna 21. The dipole antenna 21 is placed in the slot 20 and is placed horizontally along the length of the slot 20. The antenna electric field of the dipole antenna 21 is spatially orthogonal to the antenna electric field of the second ultra-wideband antenna excited by the first/second type of first excitation unit. Preferably, the excitation mode of the first/second type of first excitation unit is dipole excitation, and the first/second type of first excitation unit and the dipole antenna 21 may be placed perpendicularly and orthogonally. The antenna electric field of the dipole antenna 21 may be spatially orthogonal to the antenna electric field of the second ultra-wideband antenna excited by the first/second type of first excitation unit, so as to improve the isolation between the dipole antenna 21 and the second ultra-wideband antenna excited by the first/second type of first excitation unit. The antenna structure is applied to a notebook computer, a three-antenna system is formed in the area where the hinge 12 on one side is located. The three-antenna system includes the first ultra-wideband antenna, the second ultra-wideband antenna, and the dipole antenna 21. A six-antenna system may be obtained by the above antennas design at the areas of the hinges on two sides. According to actual applications, the above-mentioned antenna system may be used in the design of antennas including WWAN, MIMO, WLAN, UWB, BT and Navigation.

Figure 18:
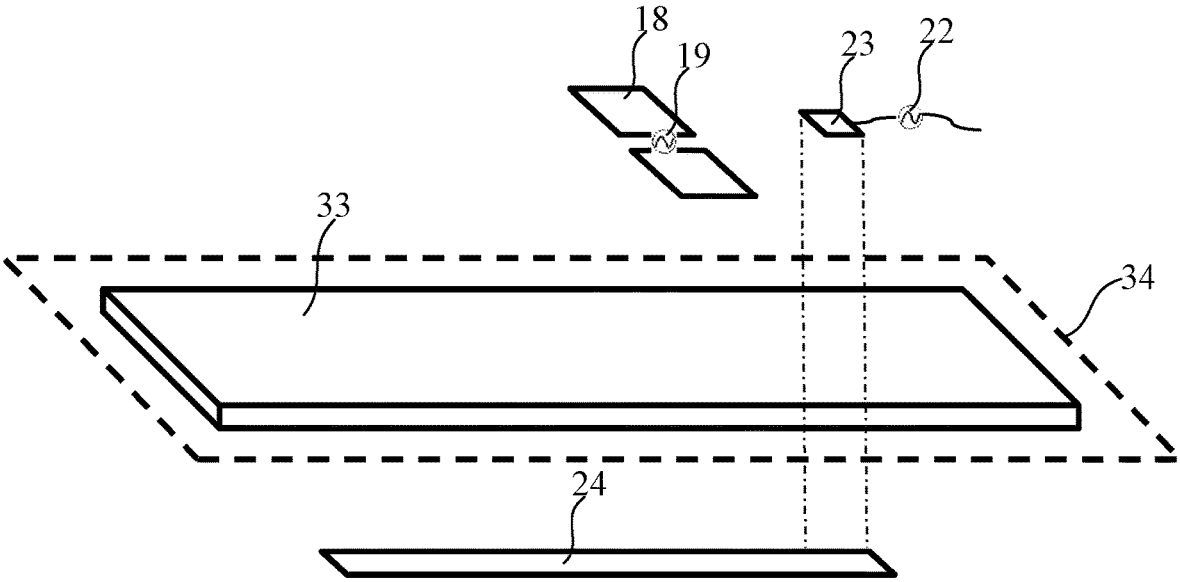
FIG. 18 is a schematic diagram showing spatial structure distribution of different antennas in embodiment 2 of the present disclosure.

As an example, the dipole antenna 21 may adopt a direct excitation or coupling excitation method. As shown in FIGS. 17 and 18, the dipole antenna 21 adopts a coupling excitation method. The dipole antenna 21 includes a signal source 22, an excitation component 23 connected with the signal source of the dipole antenna 22, and a dipole antenna trace 24. The excitation component 23 couples the signal of the signal source of the dipole antenna 22 to the dipole antenna trace 24, such that the dipole antenna trace 24 works in the dipole-like antenna mode. The dipole antenna trace pattern may be straight or meandered or a combination thereof. The structural shape and spatial position of the excitation component 23 and the dipole antenna trace 24 are not limited herein, as long as the excitation component 23 is capable of coupling the signal of the signal source of the dipole antenna 22 to the dipole antenna trace 24. For example, as shown in FIG. 18, when the excitation component 23 and the dipole antenna trace 24 are located in different spatial layers, in physical structure, the excitation component 23 and the projection part of the dipole antenna trace 24 are non-electrically overlapped or separated by a certain distance. When the excitation component 23 and the dipole antenna trace 24 are located in the same spatial layer, in physical structure, the projection of the excitation component 23 and the dipole antenna trace 24 are partially separated by a certain distance. When the excitation mode of the first type of first excitation unit 18 is dipole excitation, in physical structure, the first excitation unit 23 may be non-electrically overlapped with the projection part of the dipole antenna trace 24 of the dipole antenna 21, to improve antenna integration while ensuring antenna isolation.

As an example, the dipole antenna trace 24 of the dipole antenna 21 may serve as a sensing pad of a distance sensor to realize the dual functions of an antenna and a sensor. Preferably, the external circuit of the distance sensor is integrated on the dipole antenna trace 24 of the dipole antenna 21.

It should be noted that although it is called the dipole antenna here as mentioned above but the antenna pattern is not referred to as the common two-arm or two identical conductive elements and balance-feed in between them, It is named after due to its slightly similarity as dipole antenna radiation mode for certain band. The more proper name would be "floating" or "isolated" antenna.

Figure 11:
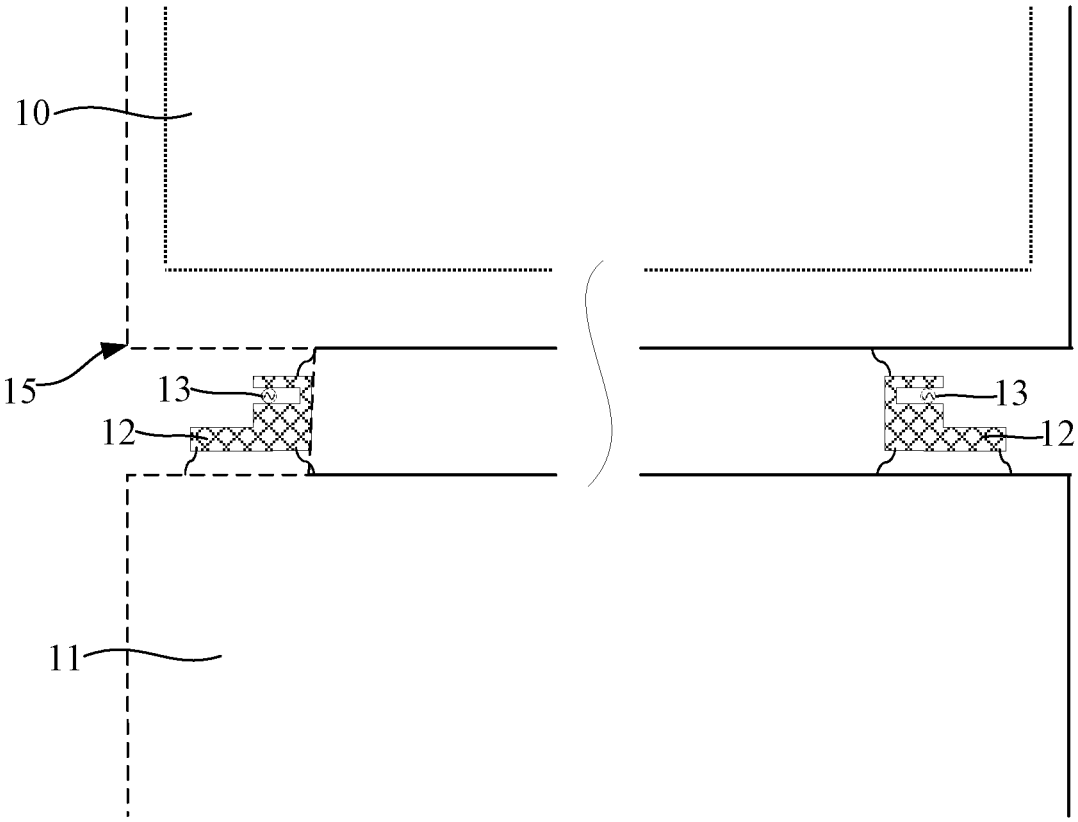

As shown in FIG. 11, as an example, when the hinge 12 has a short length, for example, the length of the hinge of the notebook computer is within 15 mm, the electrical connection structure 14 may be integrated on the hinge 12. At this time, the hinge 12 serves as an electrical connection structure for electrically connecting the upper half 10 and the lower half 11. The antenna structure is applied to a notebook computer, the hinge 12 excites the gapped groove 15 to form a first ultra-wideband antenna. The first ultra-wideband antenna may be used in the antenna design for communication frequency bands such as 2G, 3G, 4G, 5G (FR1), Navigation, BT, and Wi-Fi.

The ultra-wideband antenna for a reversible electronic device according to the present disclosure will be described in detail below in combination with specific drawings and corresponding embodiments. The described embodiments are only a part of the embodiments of the present disclosure, instead of all embodiments of the present disclosure. All other embodiments that persons of ordinary skill in the art obtain without creative efforts based on the embodiments of the present disclosure also fall within the scope of the present disclosure. The reversible electronic device in the following specific embodiments is described using a notebook computer as an example.

Embodiment 1

Figure 13:
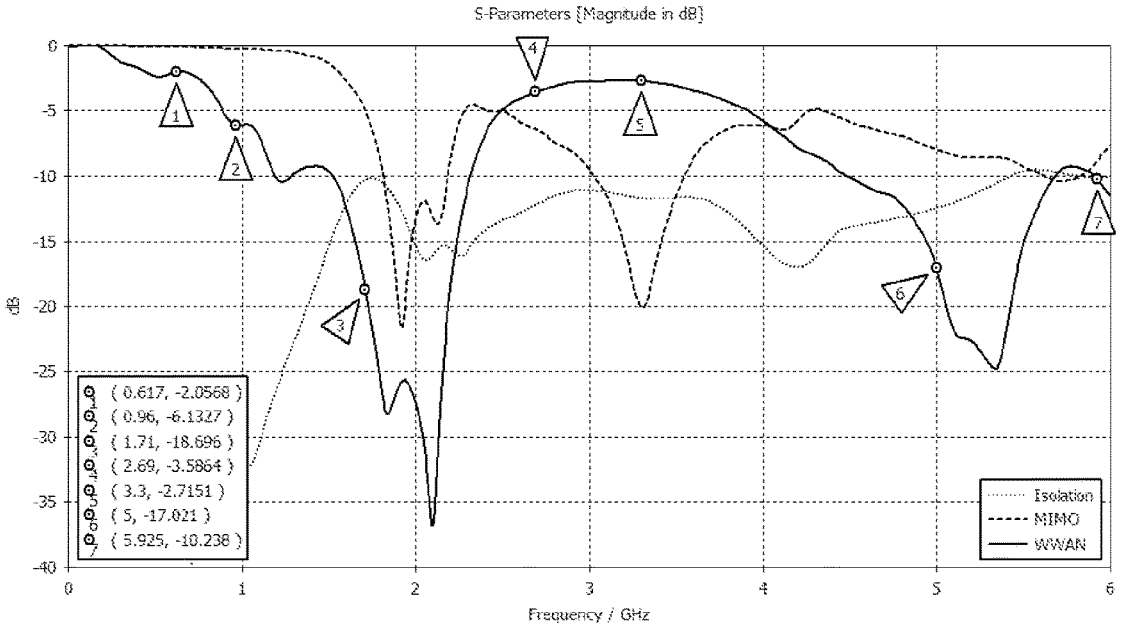
FIGS. 13 and 14 are the simulated S-parameter (isolation and return loss) diagrams and simulated efficiency diagrams of embodiment 1.
Figure 14:
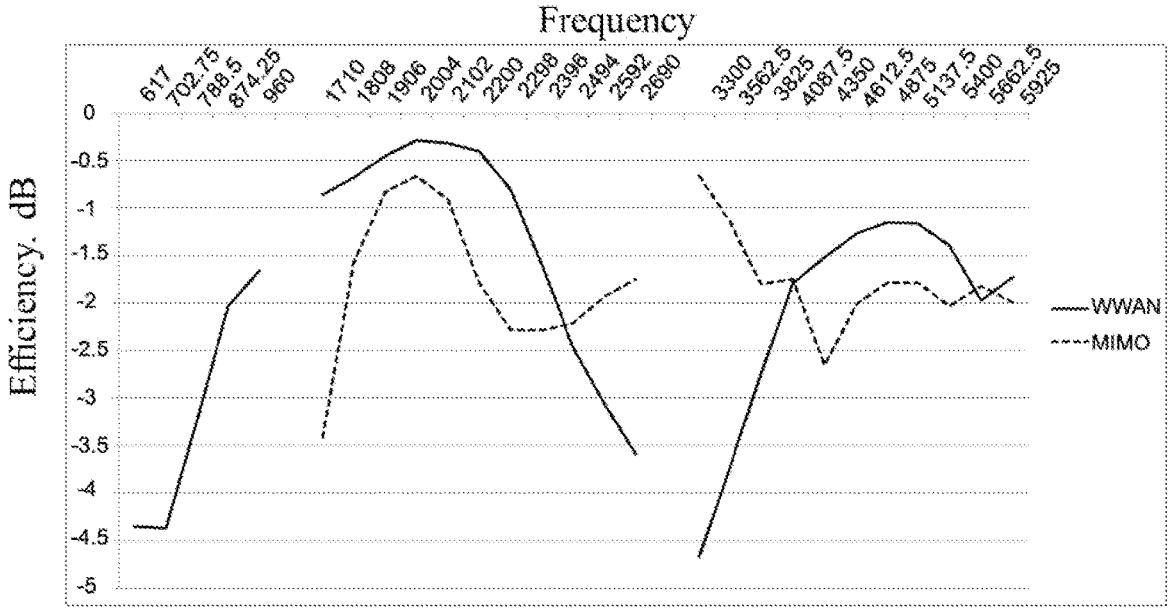
Figure 15:
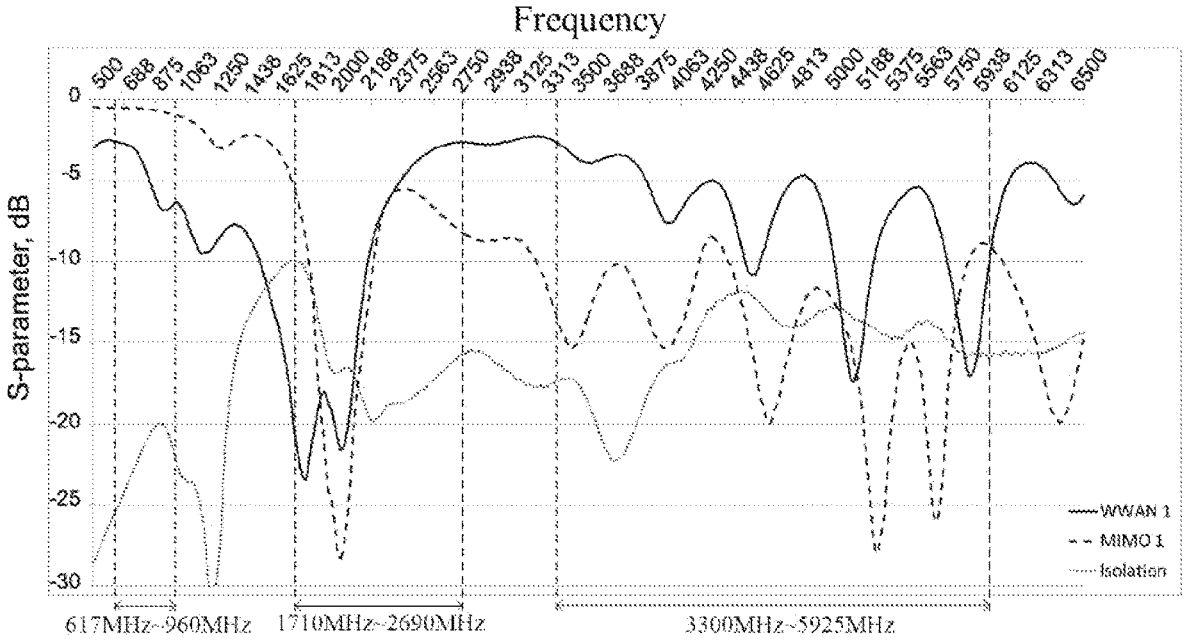
FIGS. 15 and 16 are the measured S-parameter (isolation and return loss) diagrams and measured efficiency diagrams of embodiment 1.
Figure 16:
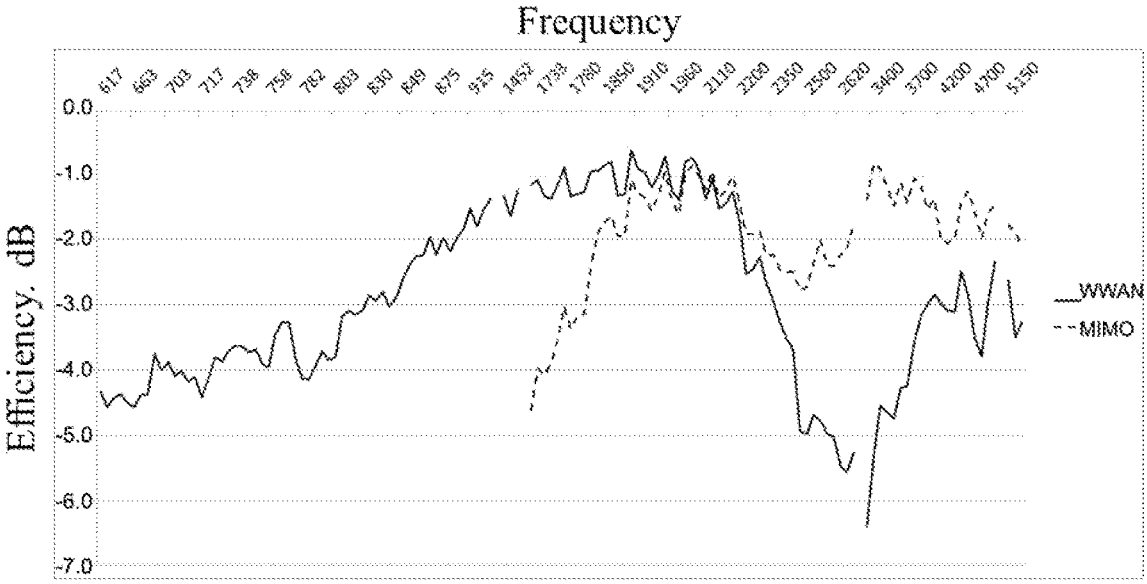

FIG. 12 shows a simplified notebook computer model, and the upper half 10 and the lower half 11 of the notebook computer are at 90°. Since the hinges on both sides are treated in the same way, a hinge 12 on one side is simulated here. A first RF signal source 13 is connected to the first end of the hinge 12, and the first end of the hinge 12 is non-electrically connected with the upper half 10. The first RF signal source 13 is a WWAN antenna signal source. The second end of the hinge 12 is electrically connected with the lower half 11. The electrical connection structure 14 is placed at the far right side of the hinge area. With reference to FIG. 9, the first type of first excitation unit 18 shown in FIG. 12 is placed in the slot 20 in the hinge area. The first type of first excitation unit 18 is dipole excitation. Note that the second type of first excitation unit 18*a* as shown in FIG. 10A may also be used to replace the first type of first excitation unit 18. The signal source 19 of the first type of first excitation unit 18 is a MIMO antenna signal source. As a result, a first ultra-wideband WWAN antenna with a working frequency band covering 600 MHz-6000 MHz (including all current 2G, 3G, 4G, and 5G (FR1) communication frequency bands) and a second ultra-wideband MIMO antenna with a working frequency band covering 1700 MHz-6000 MHz (including all working frequency bands except low frequency) are constructed. FIGS. 13 and 14 are the simulated S-parameter (isolation and return loss) diagrams and simulated efficiency diagrams of the two antennas. It can be seen from the diagrams that the isolation between the two antennas is basically less than −10 dB, which can satisfy the performance target of the antennas. FIGS. 15 and 16 are the measured S-parameter (isolation and return loss) diagrams and measured efficiency diagrams of the two antennas. Taking into account the various losses in the actual test, the antenna performance is basically consistent with the simulation results. The matching circuit has not been considered in the simulation and actual test, therefore, there is room for further improvement of antenna performance. FIG. 12A shows a practical Balun that connects to the first type of first excitation unit.

Embodiment 2

Figure 19:
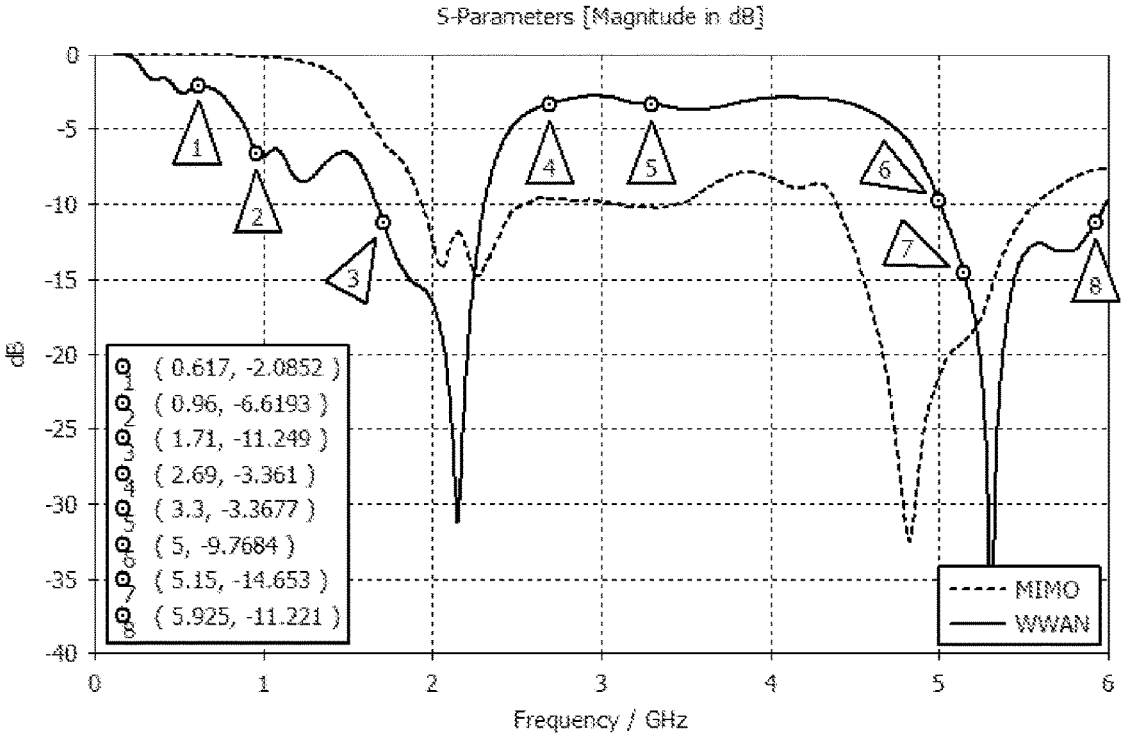
FIGS. 19 and 20 are simulated return loss diagrams of three antennas in embodiment 2.
Figure 20:
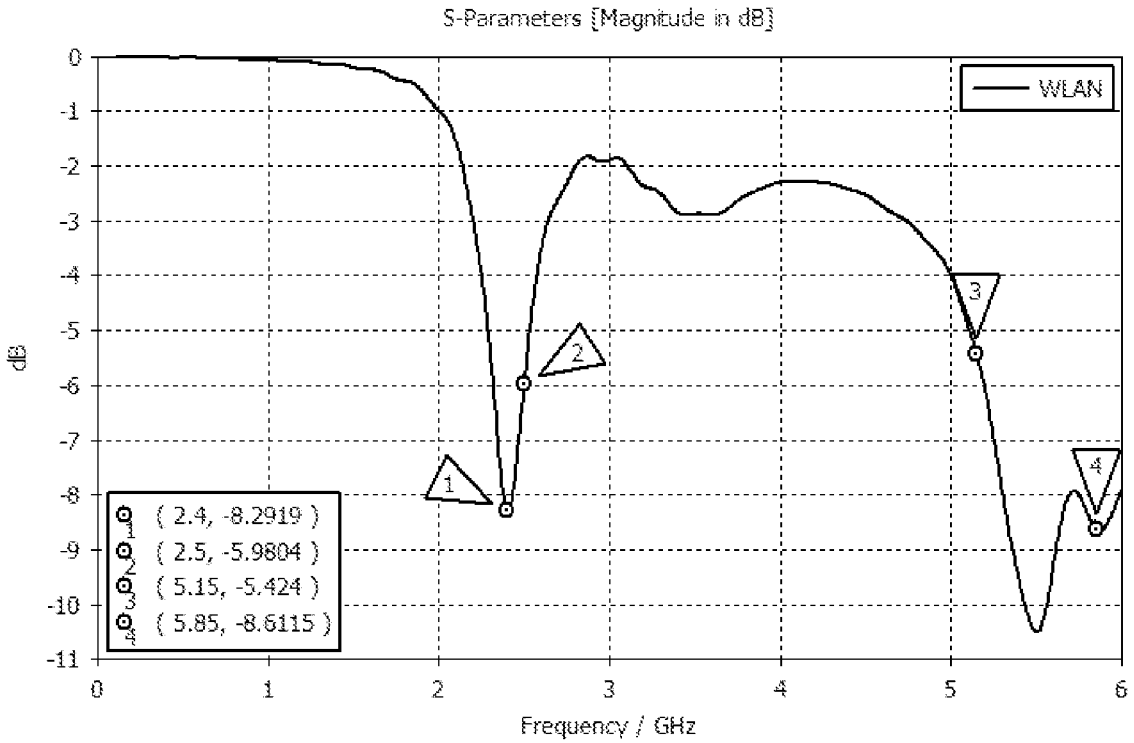
Figure 21:
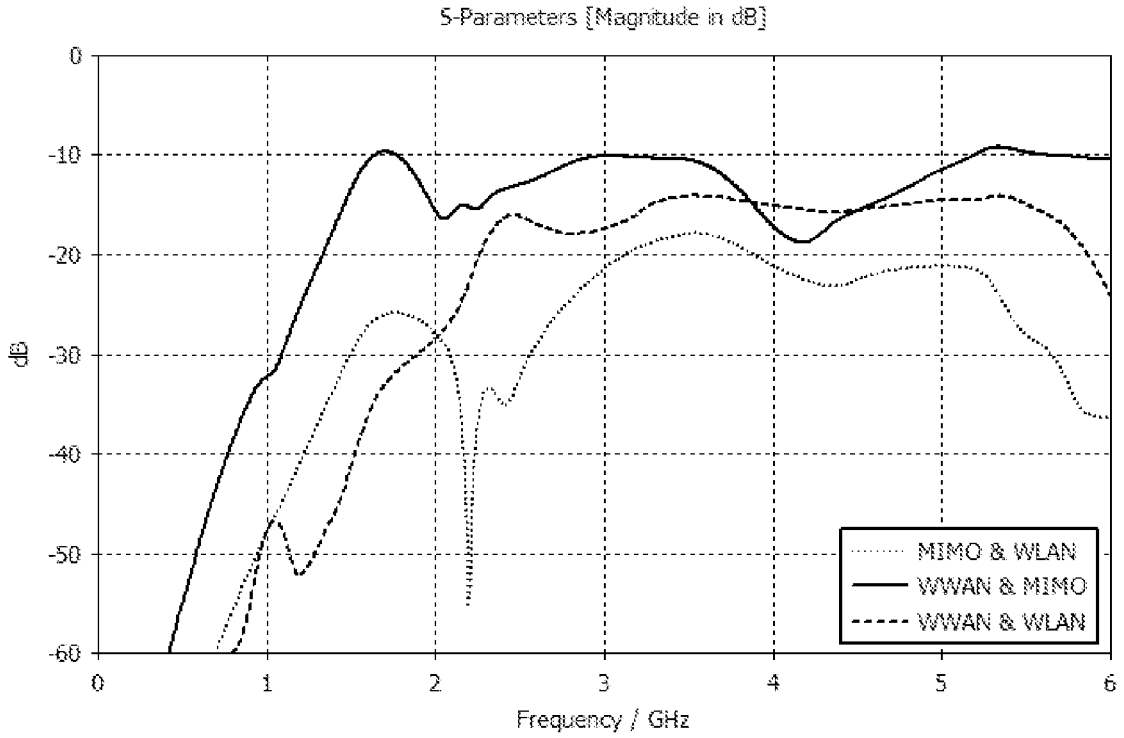
FIG. 21 is a simulated isolation comparison diagram of three antennas in embodiment 2.
Figure 22:
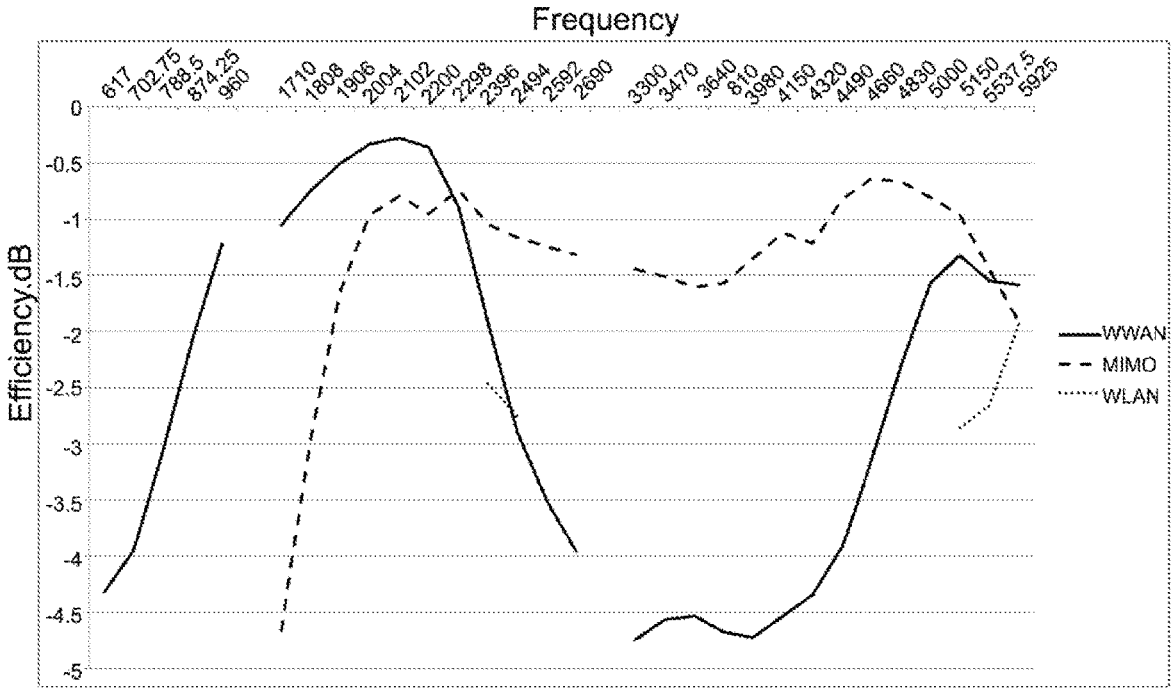
FIG. 22 is a simulated efficiency diagram of three antennas in embodiment 2.
Figure 23:
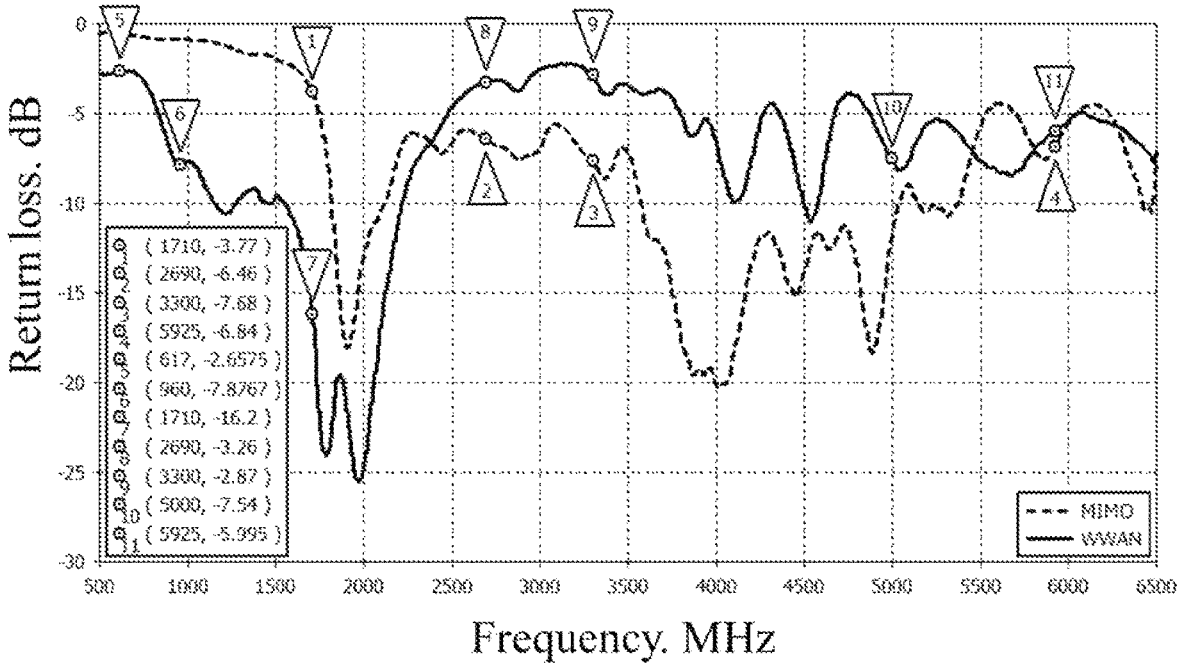
FIGS. 23 and 24 are measured return loss diagrams of three antennas in embodiment 2.
Figure 24:
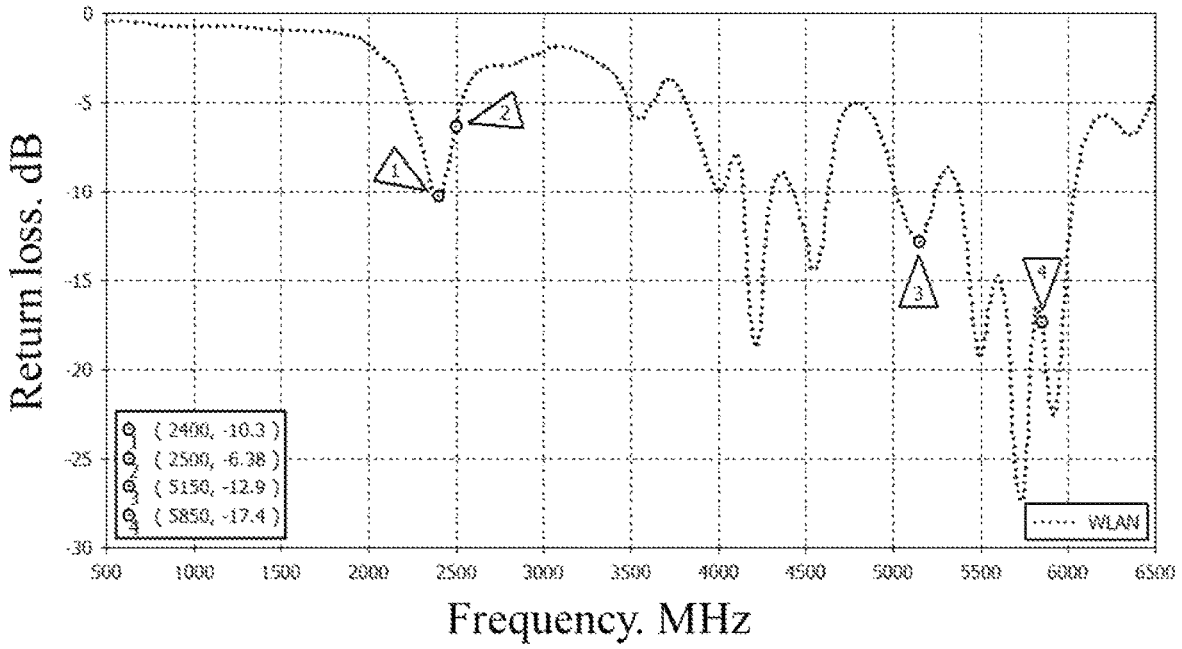
Figure 25:
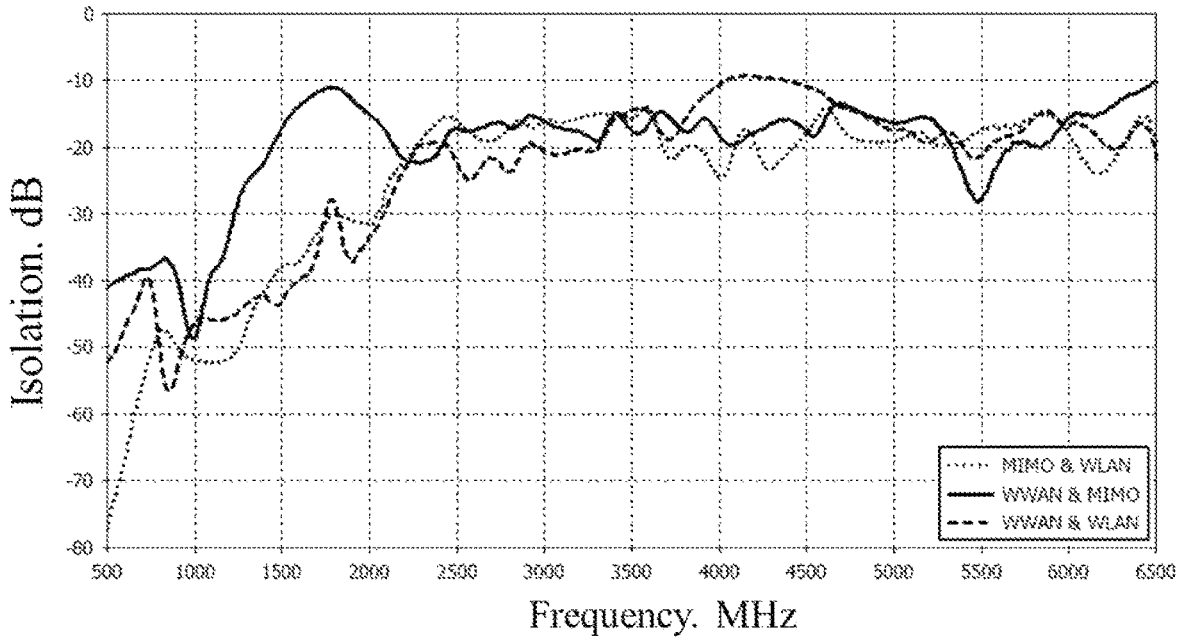
FIG. 25 is a measured isolation comparison diagram of three antennas in embodiment 2.
Figure 26:
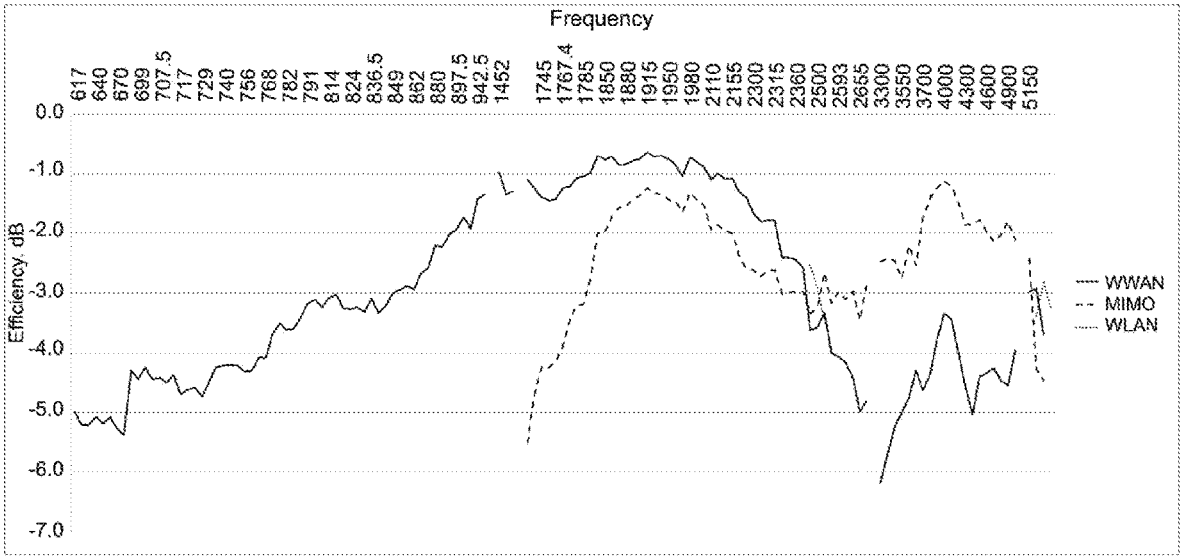
FIG. 26 is a measured efficiency diagram of three antennas in embodiment 2.

As shown in FIGS. 10, 17 and 18, on the basis of Embodiment 1, a dipole antenna 21 is placed in the slot 20 and is placed horizontally along the length of the slot 20. The dipole antenna 21 adopts a coupling excitation method. Specifically, the signal source of the dipole antenna 22 is a WLAN antenna signal source, and the feed point is located on the right side of the first type of first excitation unit 18. The first type of first excitation unit 18 and the excitation unit (including the signal source of the dipole antenna 22 and the excitation component 23) of the dipole antenna 21 are located on an upper layer of an insulating medium 33. The dipole antenna trace 24 is located on a lower layer of the insulating medium 33. The excitation component 23 and the dipole antenna trace 24 are partially overlapped in the projection areas. The dipole antenna 21 and the first type of first excitation unit 18 are placed perpendicularly and orthogonally, and the projection areas may partially overlap. Note that the second type of first excitation unit 18*a* as shown in FIG. 10A may also be used to replace the first type of first excitation unit 18. In combination with the WWAN antenna and MIMO antenna in Embodiment 1, Embodiment 2 realizes a three-antenna design of WWAN, MIMO and WLAN antennas in a hinge area on one side. FIGS. 19 and 20 are simulated return loss diagrams of the three antennas in this embodiment. FIG. 21 is a simulated isolation comparison diagram of the three antennas in this embodiment. FIG. 22 is a simulated efficiency diagram of the three antennas in this embodiment. As can be seen from the above figures, the WLAN antenna is successfully added to the hinge space without affecting the performance of WWAN and MIMO antennas. Moreover, the mutual isolation among the three antennas is basically less than −10 dB, which can satisfy the performance target of the antennas. In the actual test, to reduce the effect of the MIMO antenna feed coaxial line on the antenna area, as shown in FIG. 17A, a balun structure is introduced into the first type of first excitation unit 18, so as to weaken the current on the outer conductor of the coaxial line and ensure the isolation between the antennas. FIGS. 23 and 24 show the measured return loss in this embodiment. FIG. 25 shows the measured isolation between the antennas. FIG. 26 shows the measured antenna efficiency. The measured isolation between the antennas is basically less than −10 dB, and the performance of each antenna is basically the same as the simulation. A six-antenna design with two WWAN antennas, two MIMO antennas and two WLAN antennas can be realized by the hinges on both sides.

Embodiment 3

Figure 27:
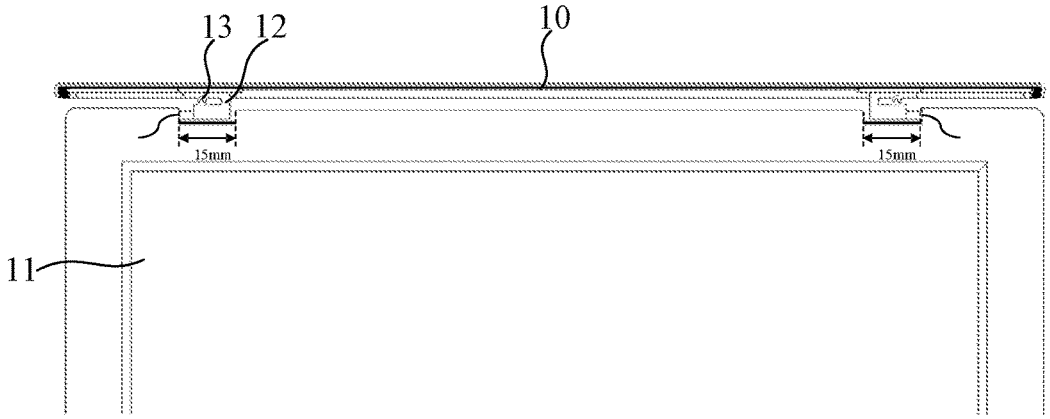
FIG. 27 shows a schematic diagram of an ultra-wideband antenna for a reversible electronic device according to embodiment 3 of the present disclosure.
Figure 28:
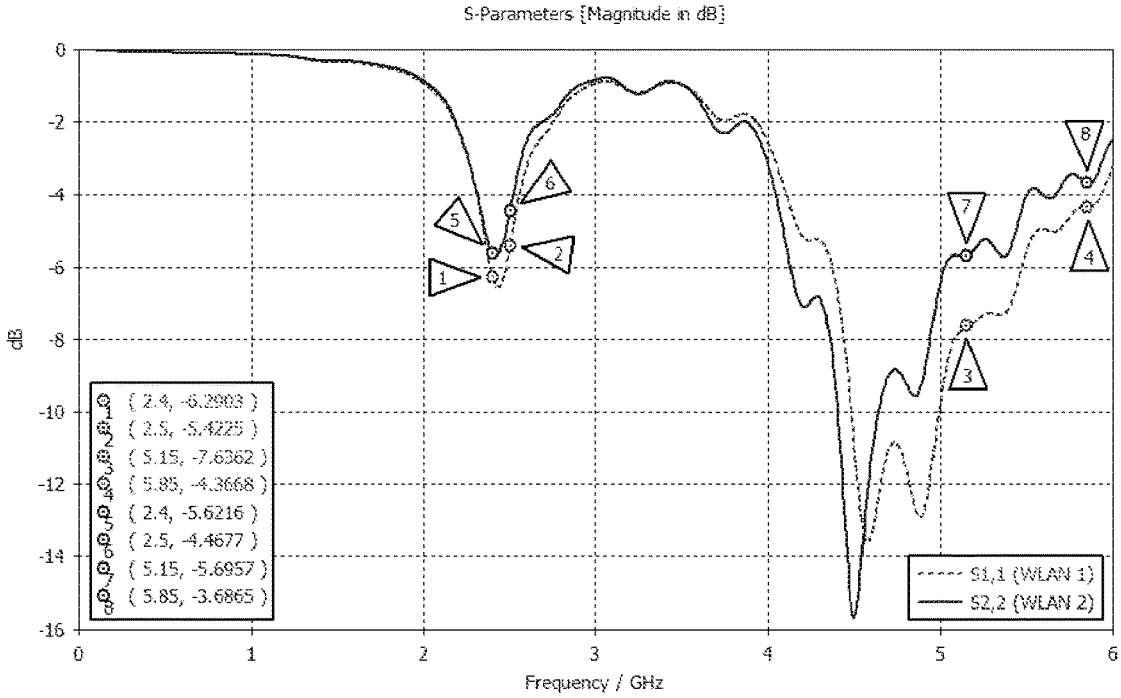
FIGS. 28 and 29 are the simulated return loss diagram and simulated efficiency diagram of embodiment 3.
Figure 29:
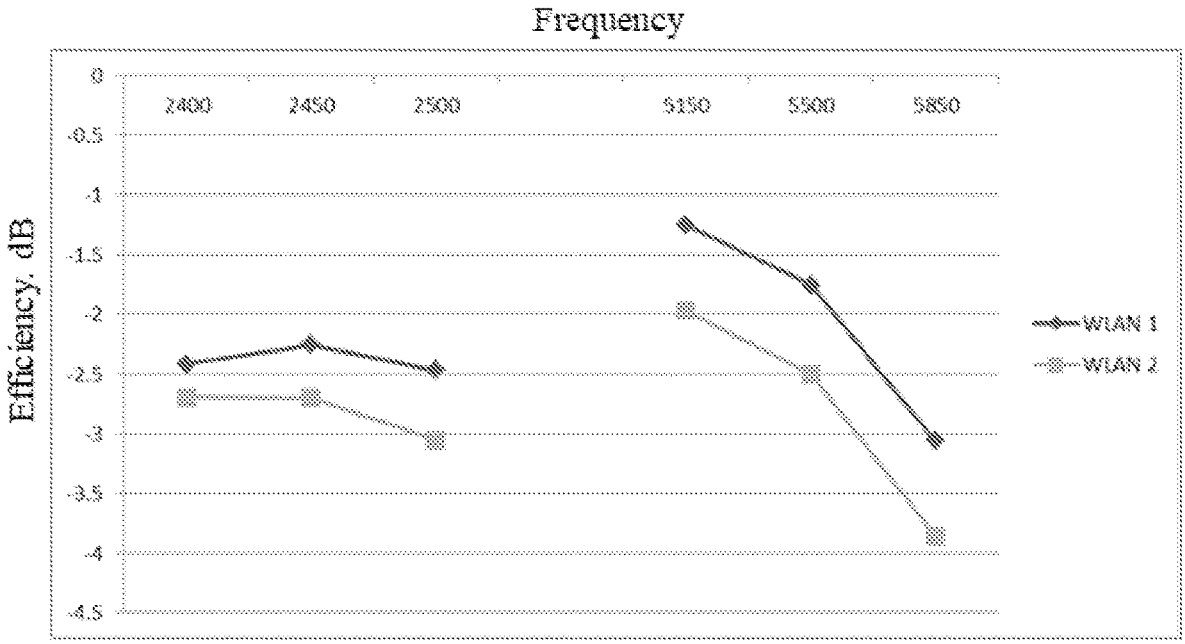
Figure 30:
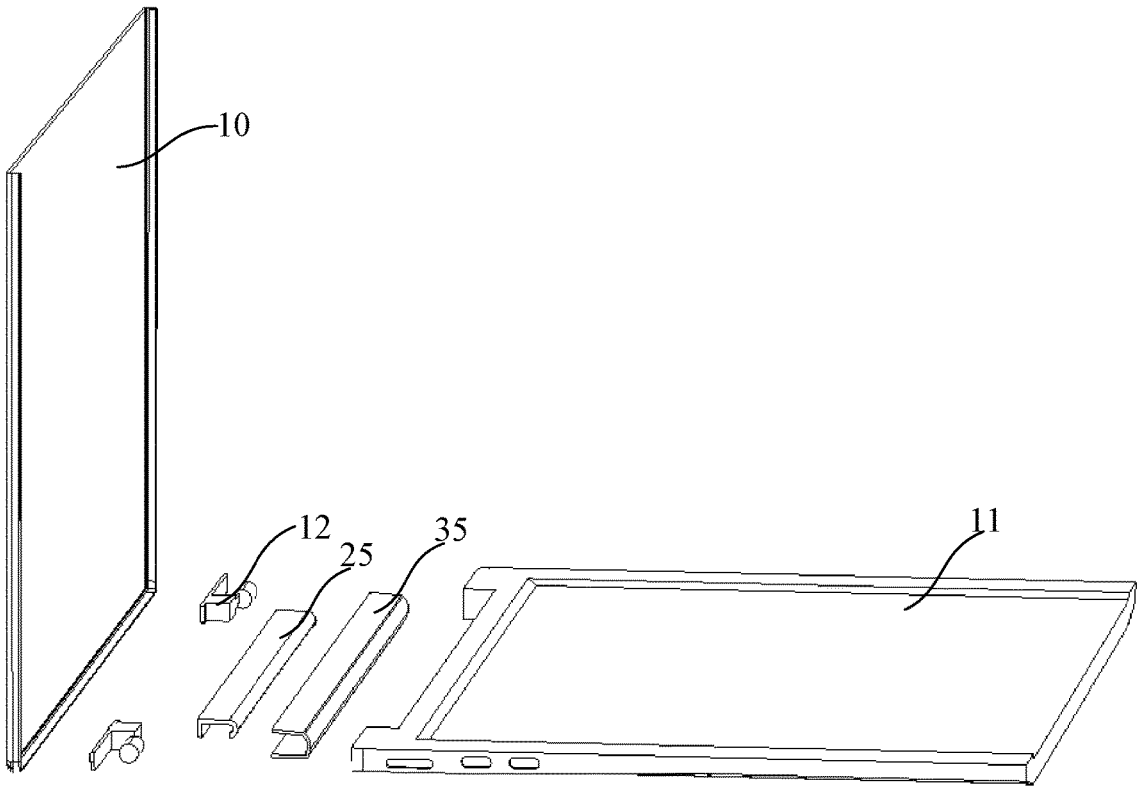
FIGS. 30 to 35 are schematic diagrams of an ultra-wideband antenna for a reversible electronic device according to embodiment 4 of the present disclosure.

As shown in FIGS. 11 and 27, this embodiment provides a specific application when the notebook computer of the present disclosure is used for WLAN antenna design. According to specific applications, the length of the hinge 12 may be shortened. For example, the length of the hinge 12 in this embodiment is 15 mm, which is in line with the space required for the design of a small hinge in the traditional notebook computer. The electrical connection structure 14 is integrated on the hinge 12. In this case, the hinge 12 serves as an electrical connection structure for electrically connecting the upper half 10 and the lower half 11. The first RF signal source 13 is a WLAN antenna signal source and is loaded on the hinge 12. The hinge 12 excites the gapped groove 15. As a result, the design of two WLAN antennas is implemented by the hinges 12 on both sides. FIGS. 28 and 29 are the simulated return loss diagrams and simulated efficiency diagrams of the WLAN antennas in this embodiment. It can be seen from the diagrams that the antennas satisfy the performance target of the WLAN antennas.

Embodiment 4

Figure 31:
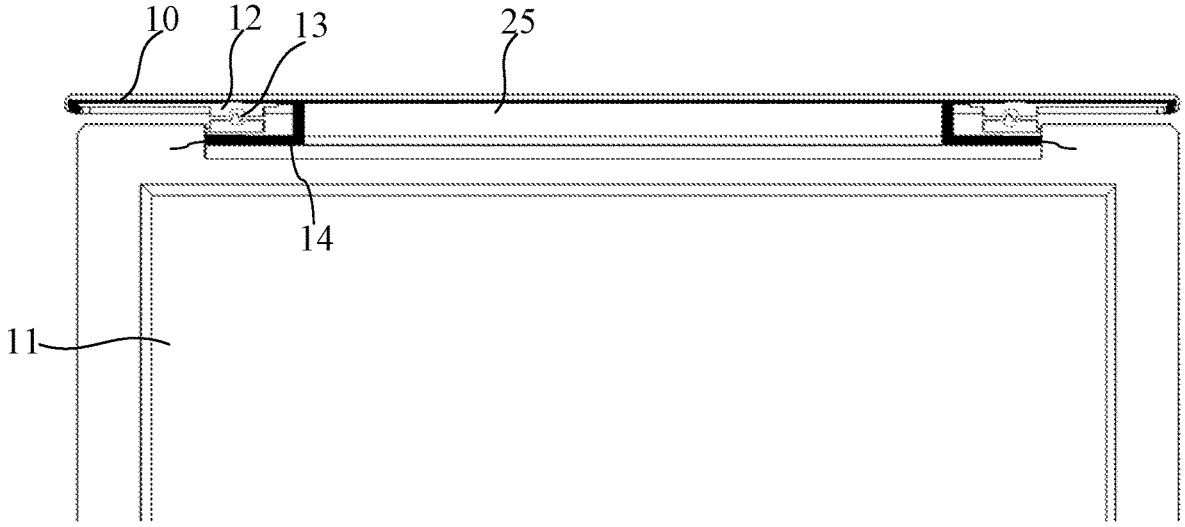
Figure 32:
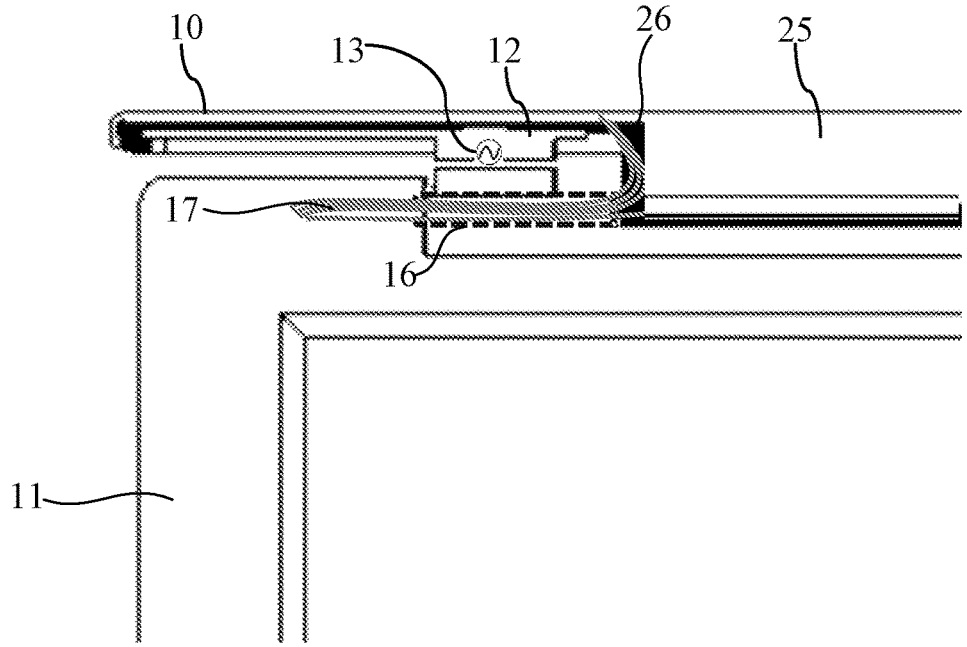

As shown in FIGS. 30-35, FIG. 30 shows an exploded schematic view of the hinge area of a traditional notebook computer. An antenna bracket 25 is enclosed in the hinge housing 35. The electrical connection structure 14 is realized by a metal trace on the antenna bracket 25. The metal trace may be in the form of laser direct structuring (LDS) or flexible printed circuit (FPC). One end of the metal trace is electrically connected with the upper half 10, and the other end of the metal trace is electrically connected with the lower half 11. The first RF signal source 13 is loaded in the hinge 12, as shown in FIG. 31. In this embodiment, the electrical connection structure is realized by a metal trace on the antenna bracket, which facilitates the design and integration of the physical structure, and simultaneously realizes the design of the two first ultra-wideband antennas. As shown in FIG. 32, a part of the electrical connection of the metal trace on the antenna bracket 25 may be realized by providing a hollow metal layer 16 wrapping the communication signal line 17 (such as a liquid crystal display (LCD) signal line, a Camera signal line, or an antenna feed coaxial line) of the notebook computer. The rest part of the electrical connection of the metal trace on the antenna bracket 25 may be realized in the form of solid metal trace 36. The solid metal trace 36 may be laser direct structuring (LDS) or flexible printed circuit (FPC). The hollow metal layer 16 can shield the high-frequency signal of the communication signal line 17, which reduces the mutual interference between the antenna and the device in this embodiment. Meanwhile, the hollow metal layer 16 can facilitate the product design of the communication signal line 17 and the electrical connection structure 14. For example, the communication signal lines 17 and the hollow metal layers 16 may have a design of Flex cable, which saves space and improves integration. Of course, the electrical connection of the metal trace on the antenna bracket 25 may all be realized by providing a hollow metal layer 16 wrapping the communication signal line 17 (such as an LCD signal line, a Camera signal line, or an antenna feed coaxial line) of the notebook computer.

Figure 33:
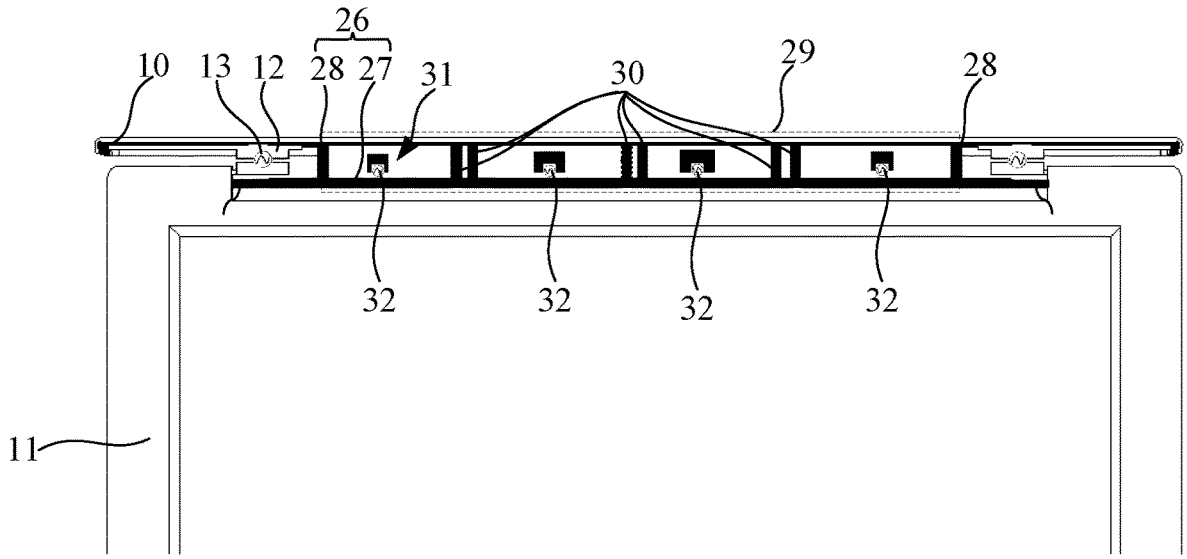

As shown in FIG. 33, the electrical connection structures 14 on the left and right sides are connected by the metal trace 26 on the antenna bracket 25 to form a long slit 29 (as shown in the dotted box in FIG. 33). In other words, the metal trace includes a long side 27 extending in the horizontal direction and a short side 28 extending in the vertical direction. The long side 27 is electrically connected with the lower half 11, and the short side 28 is electrically connected with the upper half 10. The short side 28 can be regarded as the electrical connection structure 14. The long slit 29 is formed by the metal trace 26 and the upper half 10. At least one antenna isolation ground structure 30 is provided in the vertical direction in the long slit 29. One end of the antenna isolation ground structure 30 is electrically connected with the long side 27 of the metal trace, and the other end of the antenna isolation ground structure 30 is electrically connected with the upper half 10. Antenna slits 31 are formed between the adjacent short side 28 of the metal trace 26 and the antenna isolation ground structure 30 and between adjacent antenna isolation ground structures 30. A second excitation unit 32 is placed in the antenna slit. The second excitation unit 32 excites the antenna slit 31 to form a slit antenna. Multiple (2) wideband antenna design can be realized by the number of the antenna isolation ground structures 30. A matching circuit of the antenna slit 31 may be integrated on the long side 27.

As an example, the excitation mode of the second excitation unit 32 is direct excitation or coupling excitation. For example, when the excitation mode of the second excitation unit 32 is direct excitation, the feeding may be direct feeding or loop feeding. When the excitation mode of the second excitation unit 32 is coupling excitation, the feeding may be monopole coupling feeding or dipole coupling feeding.

As an example, the isolation between the slit antennas may be improved by providing the antenna isolation ground structures 30 between the adjacent antenna slits 31. The number of the antenna isolation ground structures 30 between the adjacent antenna slits 31 may be set according to specific needs, for example, one, two or more, which is not limited herein.

Figure 34:
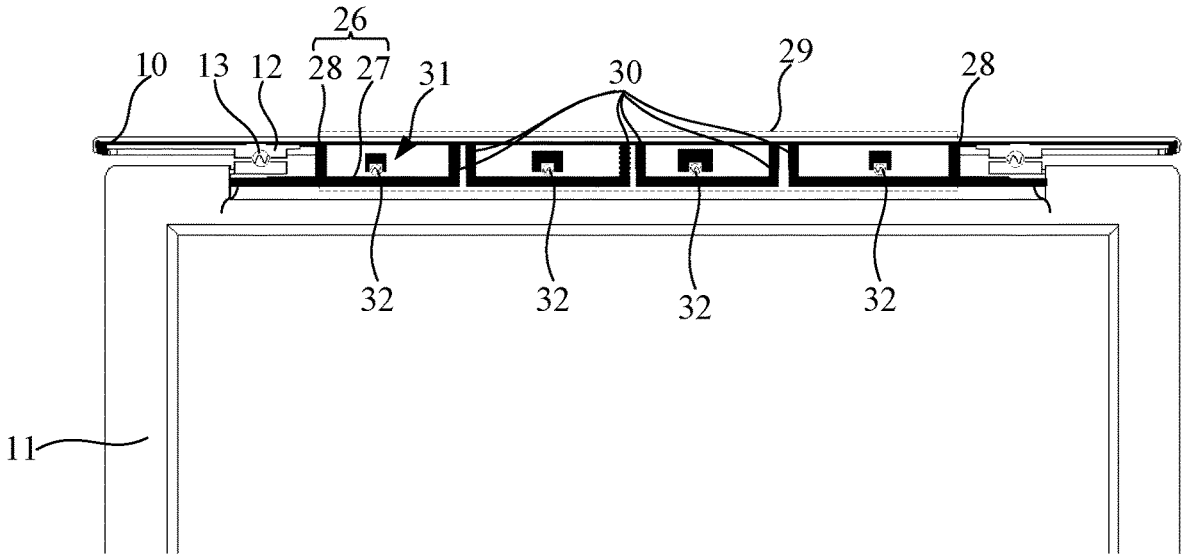

As an example, the long side 27 of the metal trace 26 may be electrically continuous or non-electrically continuous. As shown in FIG. 33, the long side 27 of the metal trace 26 is an electrically continuous long side. In this case, the long slit 29 may be understood as an enclosed long slit 29. As shown in FIG. 34, the long side 27 of the metal trace 26 is a non-electrically continuous long side. In this case, the long slit 29 may be understood as a non-enclosed long slit 29. In this embodiment, the enclosed form of the long slit 29 is not limited, as long as the antenna slit 31 that formed is an enclosed slit.

As an example, the communication signal line 17 (screen signal line, camera signal line, antenna feed coaxial line, etc.) between the upper half 10 and the lower half 11 is wired along part or all of the long side 27, the short side 28, and/or the antenna isolation ground structure 30, so as to minimize the effect on the antenna performance. It should be noted that the communication signal line 17 may be wired according to the specific conditions of the communication signal line 17. For example, the communication signal line 17 may be wired along part of the long side 27 and the short side 28; along the whole long side 27 and short side 28; along part of the long side 27 and part of the antenna isolation ground structure 30; or along part of the long side 27 and part of the antenna isolation ground structure 30 and the short side 28. The communication signal line 17 may be wired in other modes, which are not exhaustive herein. Specifically, the long side 27, the short side 28, and the antenna isolation ground structure 30 may be designed as circumferentially enclosed hollow metal layers 16. The hollow metal layer 16 internally wraps a communication signal line 17, and the communication signal line 17 is between the upper half 10 and the lower half 11. Alternatively, the communication signal line 17 between the upper half 10 and the lower half 11 is wired along part or all of the surface of the long side 27, the short side 28, and/or the antenna isolation ground structure 30. Still alternatively, the communication signal line 17 includes a ground wire and a core wire. Since the ground wire is grounded, the long side 27, the short side 28 and the antenna isolation ground structure 30 at the corresponding positions of the wiring of the communication signal line 17 may be designed to be replaced by the ground wire. As an example, the excitation component of the second excitation unit 32 may serve as a sensing pad of a distance sensor to realize the dual functions of an antenna and a sensor. Preferably, the external circuit of the distance sensor is integrated on the excitation component of the second excitation unit 32.

Figure 35:
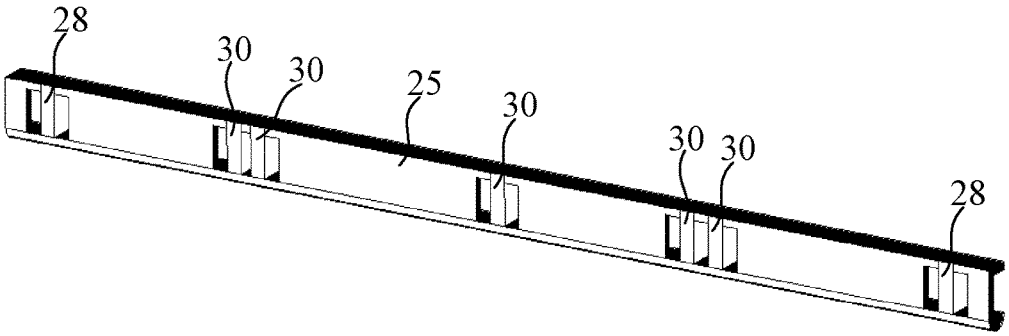
Figure 36:
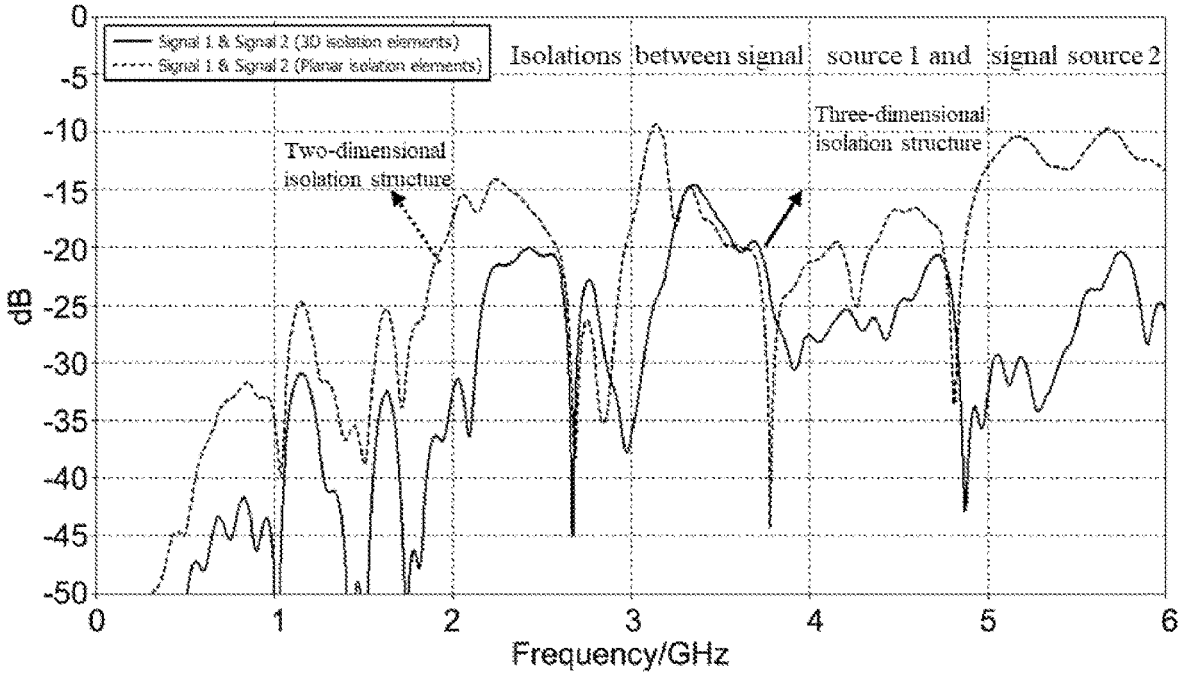
FIG. 36 shows a comparison diagram of isolations between antennas when the antenna isolation ground structure on the antenna bracket uses a two-dimensional isolation structure and a three-dimensional isolation structure respectively according to embodiment 4.

As shown in FIG. 35, unlike the traditional two-dimensional antenna isolation ground structure, this embodiment adopts a three-dimensional antenna isolation ground structure 30. By providing an opening on the antenna bracket 25, and attaching the metal trace and the antenna isolation ground structure 30 to the inner wall of the opening, the antenna isolation ground structure 30 attached to the inner wall of the opening forms a three-dimensional antenna isolation ground structure 30, and the metal trace attached to the inner wall of the opening forms a three-dimensional metal trace. The attached metal trace and the antenna isolation ground structure 30 may be in the form of FPC or LDS. FIG. 36 shows a comparison diagram of isolations between the antennas using a two-dimensional isolation structure and a three-dimensional isolation structure, respectively. The two antennas used in the diagram are the first ultra-wideband antenna and the slit antenna, respectively. The first ultra-wideband antenna is excited by the first RF signal source 13 (signal source 1 in FIG. 36) in FIG. 33, and the slit antenna is excited by the signal source (signal source 2 in FIG. 36) of the second excitation unit 32 adjacent to the first RF signal source 13. As can be seen from FIG. 36, the antenna isolation is significantly improved after the adoption of three-dimensional isolation structure and the antenna bracket of the three-dimensional metal trace. It should be noted that this embodiment only provides one three-dimensional isolation structure, however, other three-dimensional isolation structures based on the same concept also falls into the protection scope of the present disclosure.

Embodiment 5

Figure 37:
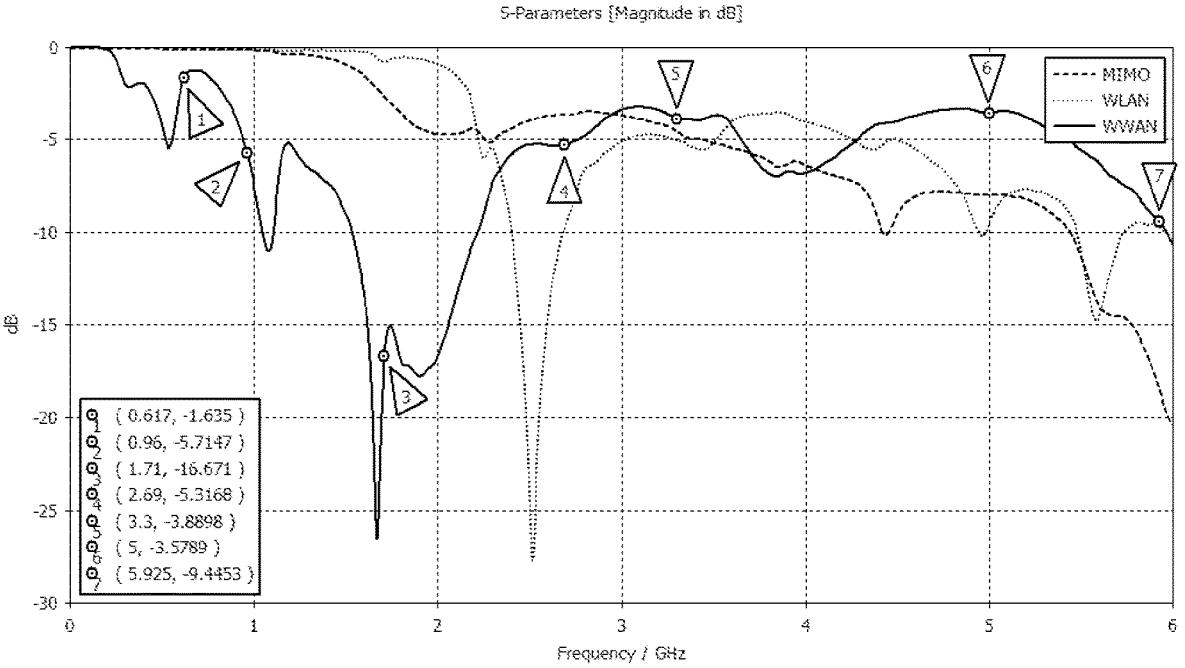
FIG. 37 is a simulated return loss diagram of three antennas in embodiment 5.
Figure 38:
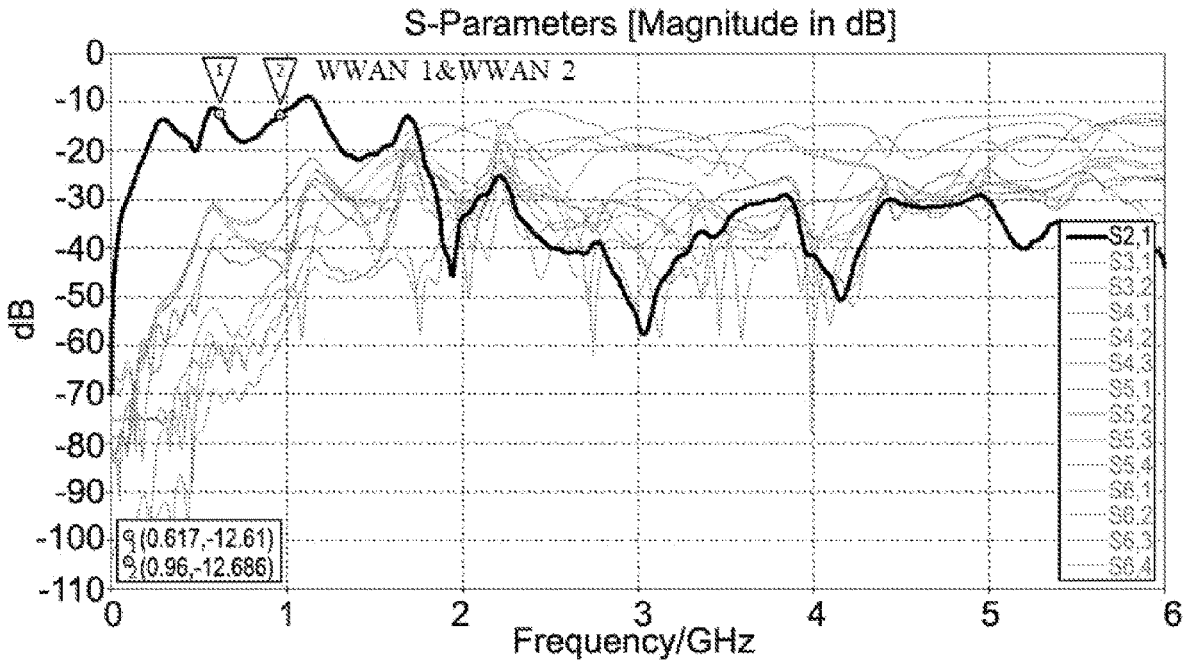
FIG. 38 is a simulated isolation comparison diagram of six antennas in embodiment 5.
Figure 39:
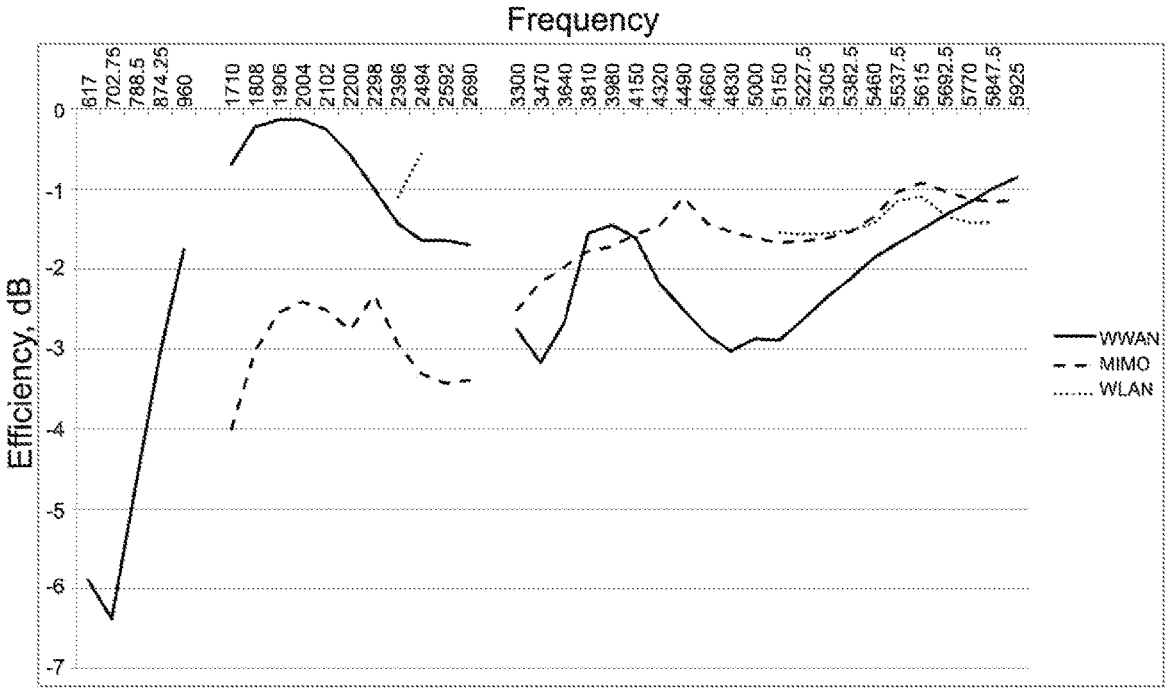
FIG. 39 is a simulated efficiency diagram of three antennas in embodiment 5.
Figure 40:
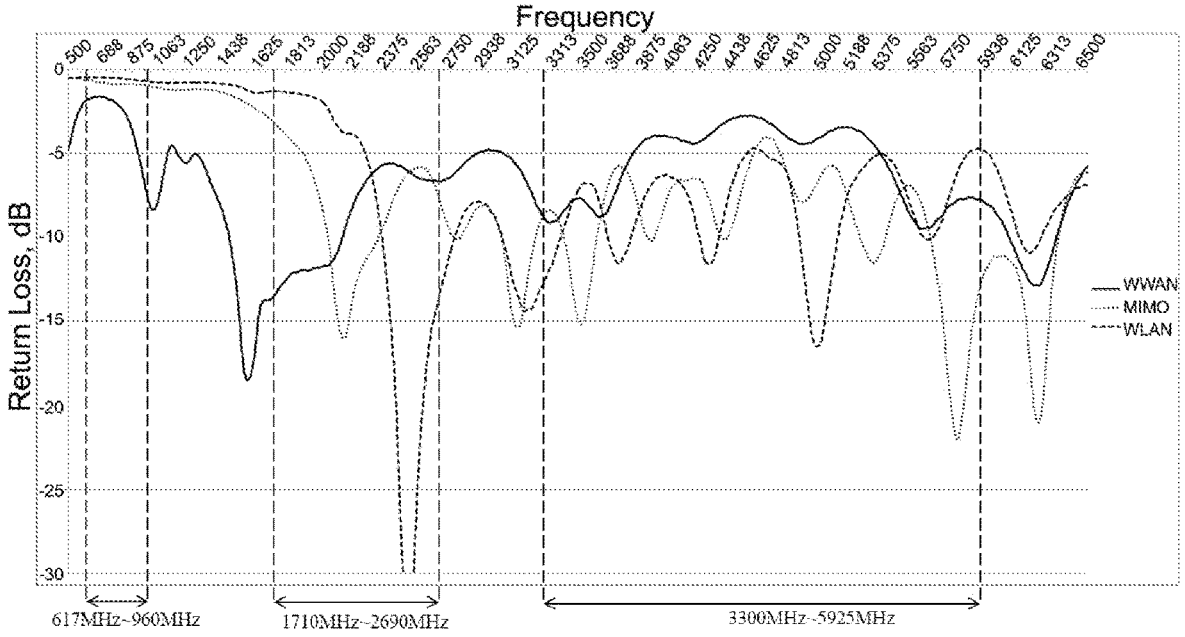
FIG. 40 is a measured return loss diagram of three antennas in embodiment 5.
Figure 41:
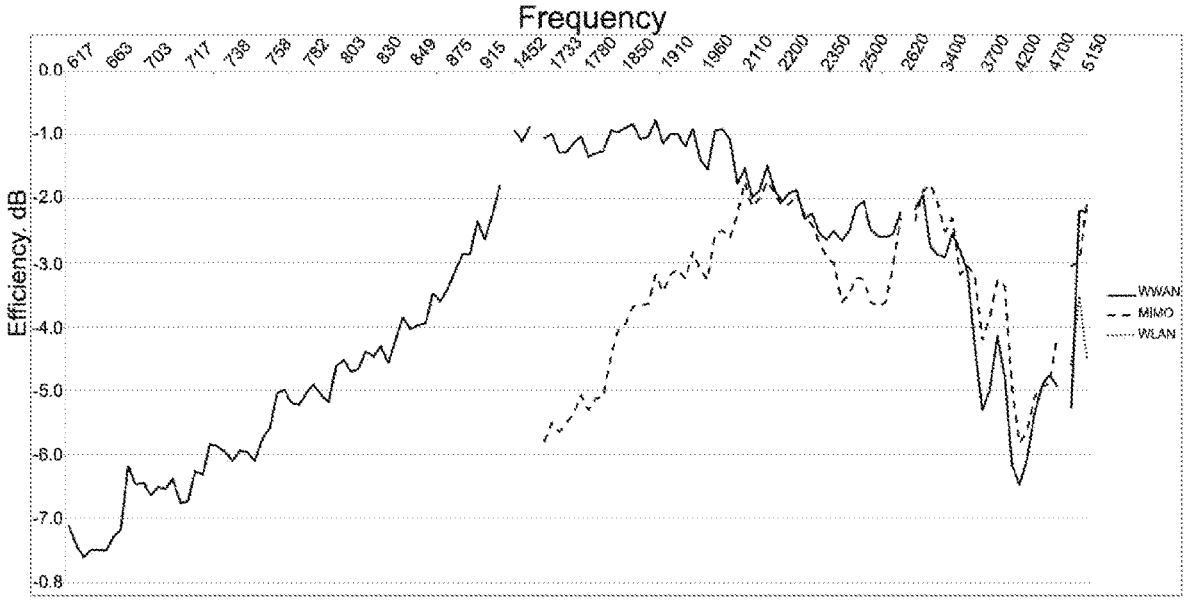
FIG. 41 is a measured efficiency diagram of three antennas in embodiment 5.
Figure 42:
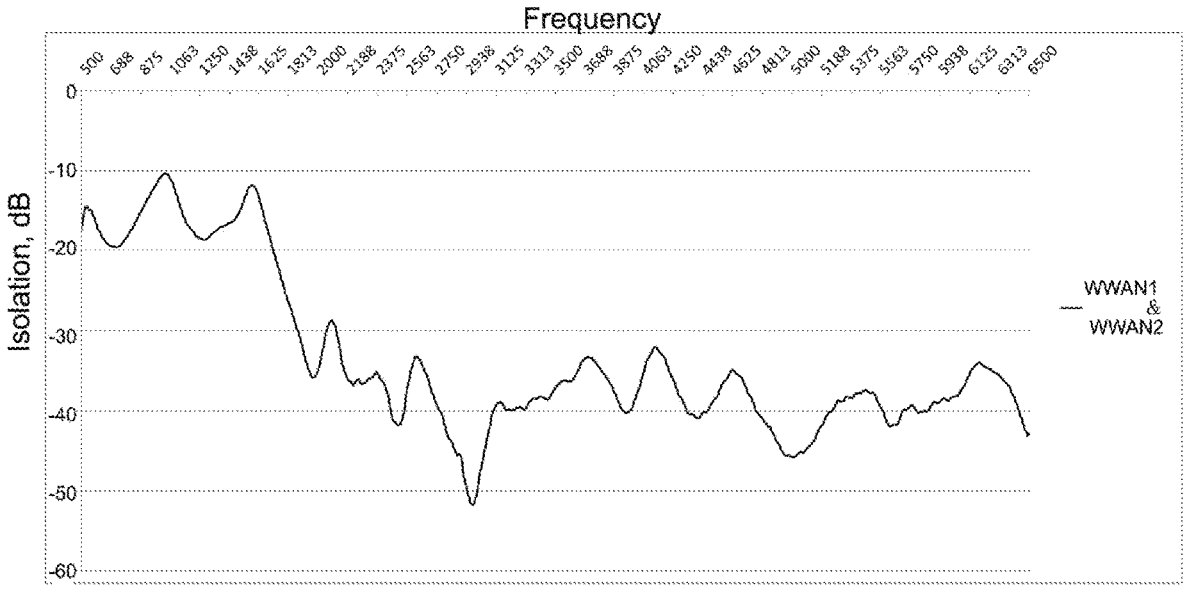
FIG. 42 is a measured isolation comparison diagram of two WWAN antennas in embodiment 5.

As shown in FIG. 33, this embodiment is basically the same as embodiment 4, except that the first RF signal source is set as a WWAN antenna signal source, the signal source of a second excitation unit 32 close to the first RF signal source is set as a WLAN signal source, and the signal source of a second excitation unit 32 far from the first RF signal source is set as a MIMO signal source. As a result, the design of six antennas is realized by the hinges 12 on both sides, including two WWAN antennas, two WLAN antennas and two MIMO antennas. The working frequency band of WWAN antenna covers 600 MHz-6000 MHz, including all current 2G, 3G, 4G, and 5G (FR1) communication frequency bands. The working frequency band of MIMO antenna ranges 1700 MHz-6000 MHz, including all working frequency bands except low frequency. The working frequency bands of WLAN antennas are 2.4 GHz and 5 GHz. Since the antenna in FIG. 33 is designed as a symmetrical structure, FIG. 37 gives a simulated return loss diagram of the three antennas in this embodiment. FIG. 38 is a simulated isolation comparison diagram of the six antennas in this embodiment. FIG. 39 is a simulated efficiency diagram of the three antennas in this embodiment. As can be seen from the above figures, the worst isolation is between the two WWAN antennas at about −12 dB, which basically satisfies the performance target of the antennas. FIG. 40 is a measured return loss diagram of the three antennas in this embodiment. FIG. 41 is a measured efficiency diagram of the three antennas in this embodiment. FIG. 42 is a measured isolation comparison diagram between the two WWAN antennas in this embodiment. Taking into account the various losses in the actual test, the antenna performance is basically consistent with the simulation results. The matching circuit has not been considered in the simulation and actual test, therefore, there is room for further improvement of antenna performance.

Embodiment 6

Figure 43:
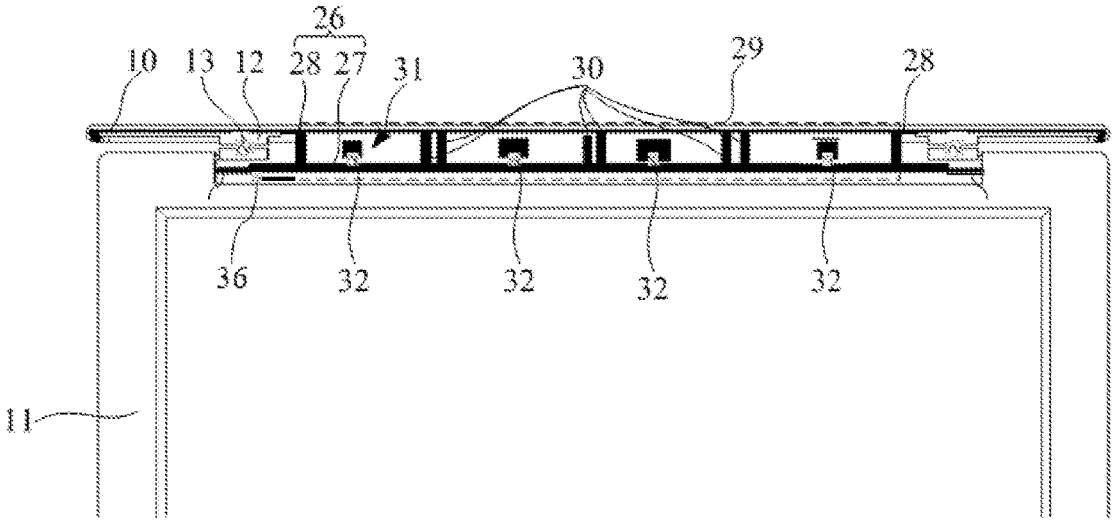
FIG. 43 shows a schematic diagram of an ultra-wideband antenna for a reversible electronic device according to embodiment 6.
Figure 44:
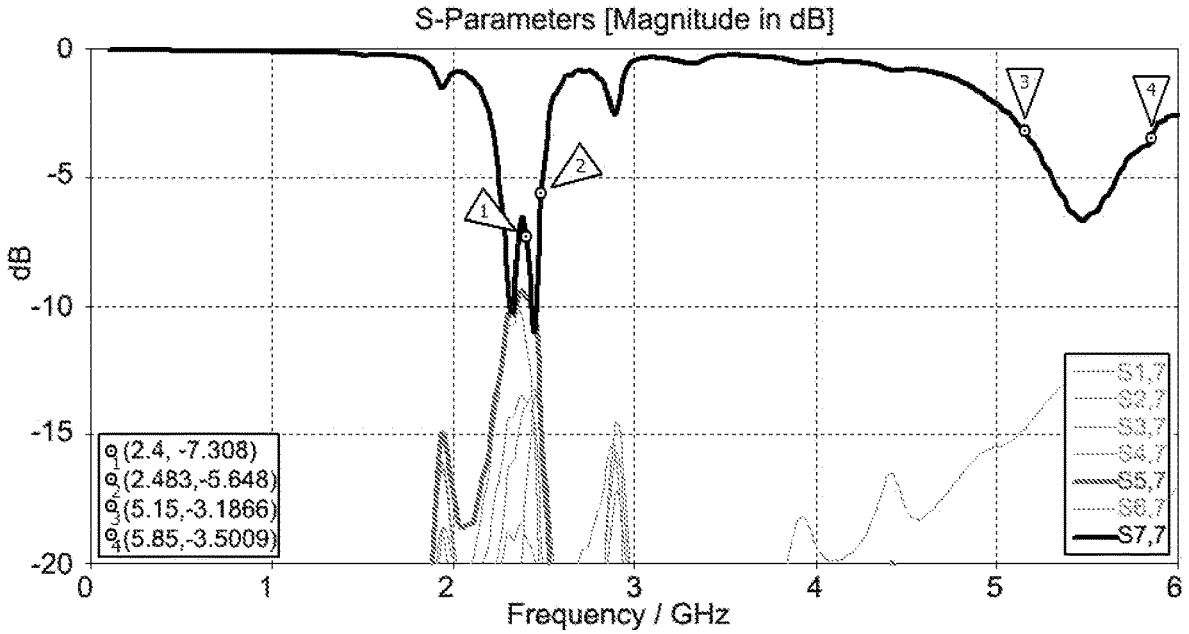
FIG. 44 shows a simulated return loss diagram and a simulated isolation parameter diagram of the WLAN antenna excited by the third excitation unit of the ultra-wideband antenna for the reversible electronic device according to embodiment 6.
Figure 45:
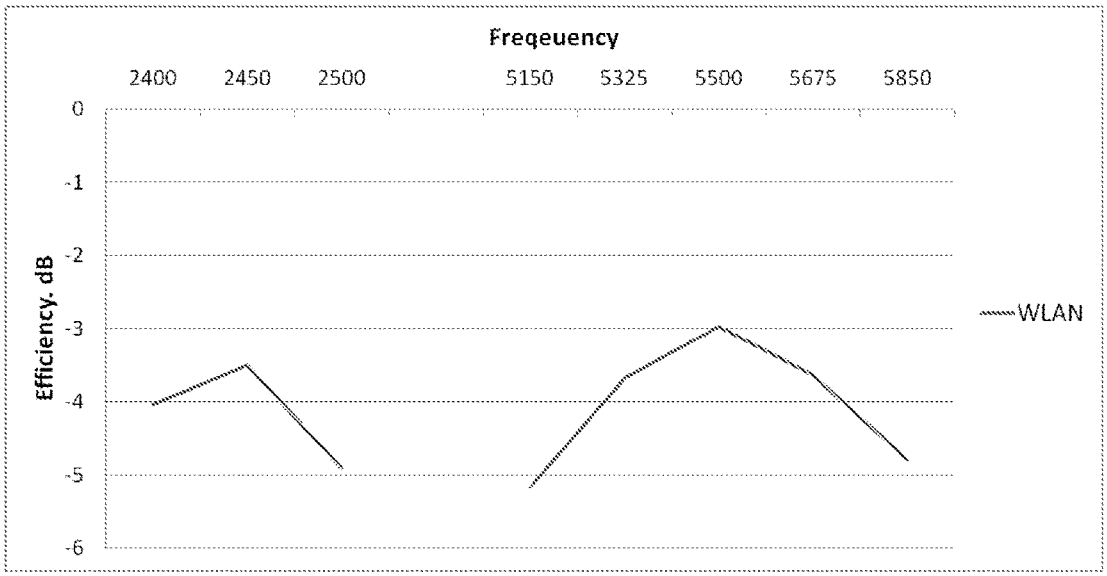
FIG. 45 shows a simulated antenna efficiency diagram of the WLAN antenna excited by the third excitation unit of the ultra-wideband antenna for the reversible electronic device according to embodiment 6.

As shown in FIG. 43, a third excitation unit 36 is placed in the long slit formed between the long side 27 extending in the horizontal direction and the lower half 11. The third excitation unit 36 includes an excitation source and an excitation component. The excitation mode of the third excitation unit 36 may be direct excitation or coupling excitation. The excitation mode of the third excitation unit 36 is coupling excitation, as shown in FIG. 43. Through appropriate matching and adjustment, another WLAN antenna is formed. So far, a seven-antenna system may be formed by combining the antennas in embodiment 5. FIG. 44 shows a simulated return loss diagram and a simulated isolation parameter diagram of this embodiment, and the antenna in-band isolation is basically better than −10 dB. FIG. 45 is a simulated antenna efficiency diagram of the WLAN antenna excited by the third excitation unit in this embodiment, which can satisfy the general performance target of the WLAN antennas. It should be noted that this embodiment only gives the application of the long slit as a WLAN antenna. However, according to actual size and optimization, the long slit formed between the long side 27 extending in the horizontal direction and the lower half 11 may also serve as a WWAN or MIMO antenna. In addition, the excitation component of the third excitation unit 36 may serve as a sensing pad of a distance sensor. Further, the excitation component of the third excitation unit 36 may serve as a sensing pad of a distance sensor alone or combined with the excitation component of the second excitation unit, which may be set according to specific conditions to improve the integration of the antenna system. Furthermore, a distance sensor may be integrated on the excitation component of the third excitation unit 36 to realize spatial multiplexing.

Embodiment 7

Figure 46:
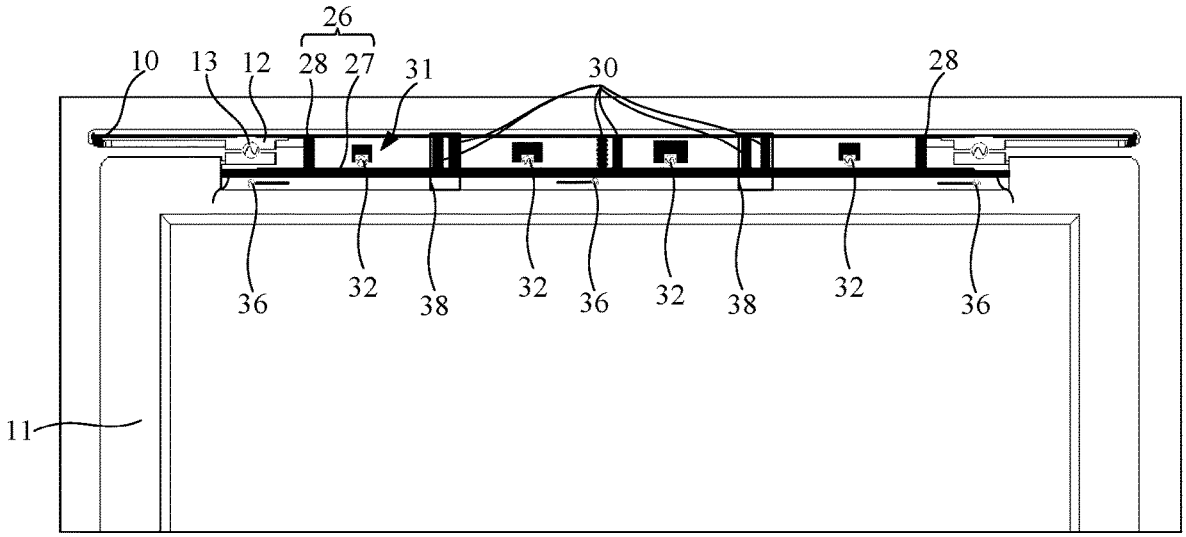
FIG. 46 shows a schematic diagram of an ultra-wideband antenna for a reversible electronic device according to embodiment 7.

As shown in FIG. 46, on the basis of Embodiment 6, at least one metal connecting wire 38 and at least two third excitation units 36 are further provided between the upper half 10 and the lower half 11. One end of the metal connecting wire 38 is connected with the upper half 10 and the other end of the metal connecting wire 38 is connected with the lower half 11. All the metal connecting wires 38 divide the long slit in embodiment 6 into several independent short slits. For example, in this embodiment, two metal connecting wires 38 are provided to divide the long slit in embodiment 6 into three independent short slits. A third excitation unit 36 is provided in each short slit to form several slit antennas. For example, in this embodiment, three slit antennas are formed. It should be noted that the metal connecting wire 38 may be a common solid metal wire, or in a form of an FPC loaded with a communication signal line between the upper half 10 and the lower half 11. The selection may be made according to actual conditions. In addition, the position of the metal connecting wire 38 may overlap with the spatial projection area of the antenna isolation ground structure 30. The position and width of the metal connecting wire 38 may be adjusted. In this embodiment, an antenna structure with more than seven antennas may be formed in combination with the antenna design in embodiment 6.

Embodiment 8

Figure 47:
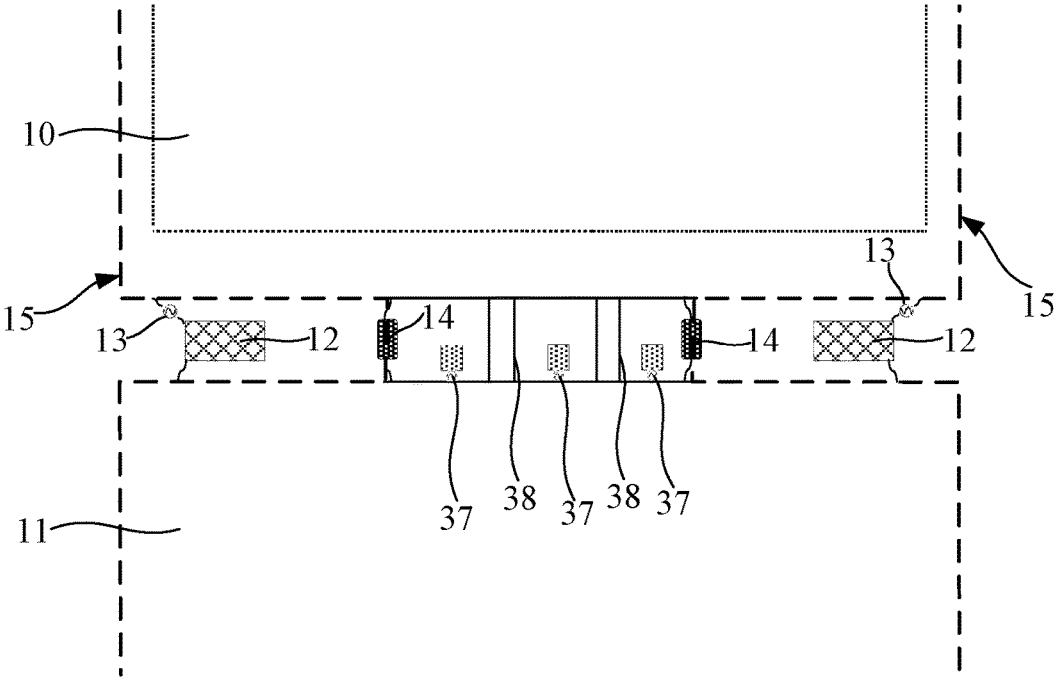
FIG. 47 shows a schematic diagram of an ultra-wideband antenna for a reversible electronic device according to embodiment 8.

As shown in FIG. 47, on the basis of the first ultra-wideband antenna formed by the present disclosure, at least one metal connecting wire 38 and a fourth excitation unit 37 are provided between the upper half 10 and the lower half 11. One end of the metal connecting wire 38 is connected with the upper half 10, and the other end of the metal connecting wire 38 is connected with the lower half 11. At least one slit is formed between the adjacent metal connecting wire 38 and the electrical connection structure 14, and between two adjacent metal connecting wires 38. For example, in this embodiment, two metal connecting wires and two electrical connection structures 14 are provided, which form three short slits. A fourth excitation unit 37 is provided in each short slit to form several slit antennas. For example, in this embodiment, three slit antennas are formed. Similarly, the fourth excitation unit 37 includes an excitation source and an excitation component. The excitation mode of the fourth excitation unit 37 may be direct excitation or coupling excitation. It should be noted that the metal connecting wire 38 may be a common solid metal wire, or in a form of an FPC loaded with a communication signal line between the upper half 10 and the lower half 11. The selection may be made according to actual conditions. In this embodiment, an antenna structure with multiple antennas may be formed by combining two of the first ultra-wideband antennas. In addition, the excitation component of the fourth excitation unit 37 may serve as a sensing pad of a distance sensor to improve the integration degree of the antenna system. Furthermore, a distance sensor may be integrated on the excitation component of the fourth excitation unit 37 to realize spatial multiplexing.

Embodiment 9

Figure 48A:
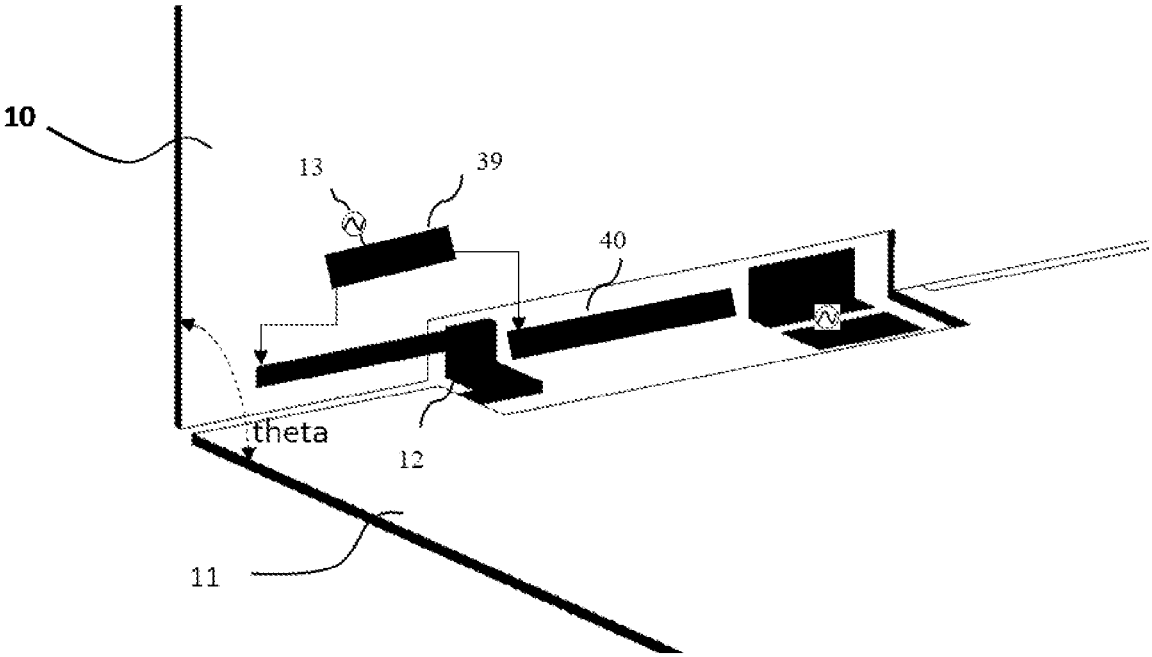
FIG. 48A shows a schematic diagram of an ultra-wide-band antenna for a reversible electronic device according to embodiment 9.
Figure 48B:
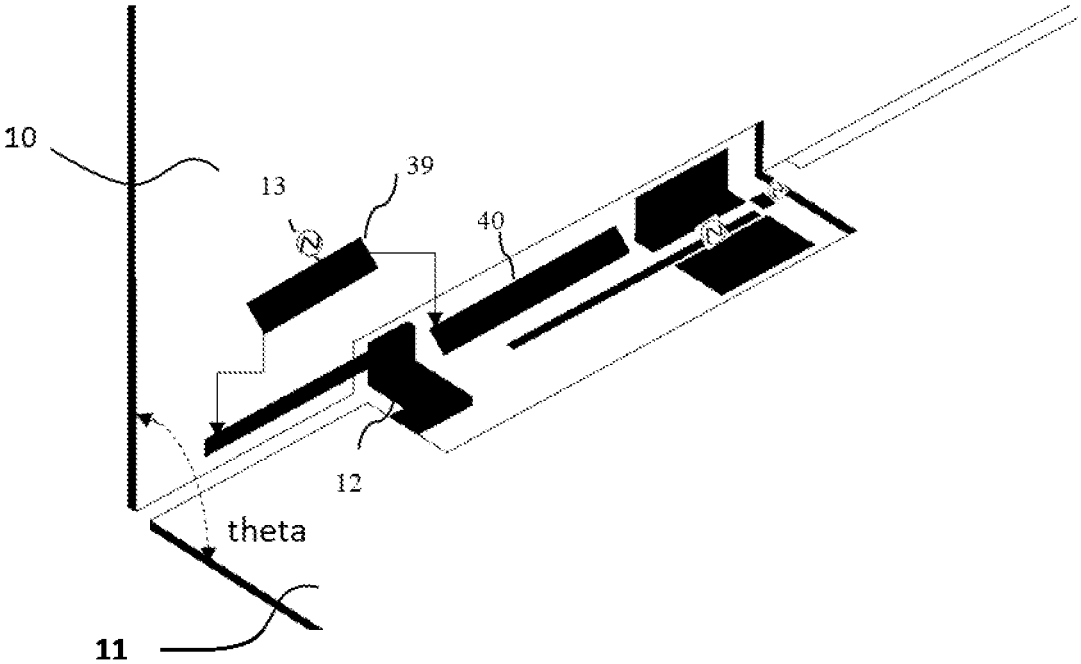
FIG. 48B shows a schematic diagram of an ultra-wide-band antenna for a reversible electronic device according to embodiment 9.

As shown in FIG. 48A and FIG. 48B, this embodiment provides a specific application when the notebook computer of the present disclosure is in close or tablet mode. When the notebook computer is in close or tablet mode, the hinge ultra-wideband antennas do not work well due to the poor antenna efficiency and isolation between the two hinge ultra-wideband antennas. In order to improve the isolation and antenna performance of a notebook computer in close and tablet mode, based on FIG. 12 and FIG. 17 as described in Embodiment 1 and 2, the ultra-wideband antenna for the reversible electronic device further includes: an antenna electronic switch 39, a monopole antenna 40 and a first RF signal source 13. The monopole antenna 40 is disposed in the proximity of the hinge 12 and in the slot 20 (the slot is formed by the upper half, the lower half, the hinge and the electrical connection structure, as described above). The antenna electronic switch 39 is disposed between the first RF signal source 13 and the monopole antenna 40 (or the hinge 12). The antenna electronic switch 39 is a Single-Pole-Double-Throw (SPDT) having one RF input end and two RF output ends. The "Theta" in FIG. 48A and FIG. 48B refers to the rotation angle between the upper half and the lower half. "Theta=0 degree" refers to close mode and "Theta=360 degree" refers to tablet mode.

The switch state (or RF signal path) of the ultra-wideband antenna may be selected by the antenna electronic switch 39 using a sensor or a received signal strength indicator (RSSI).

Figure 49A:
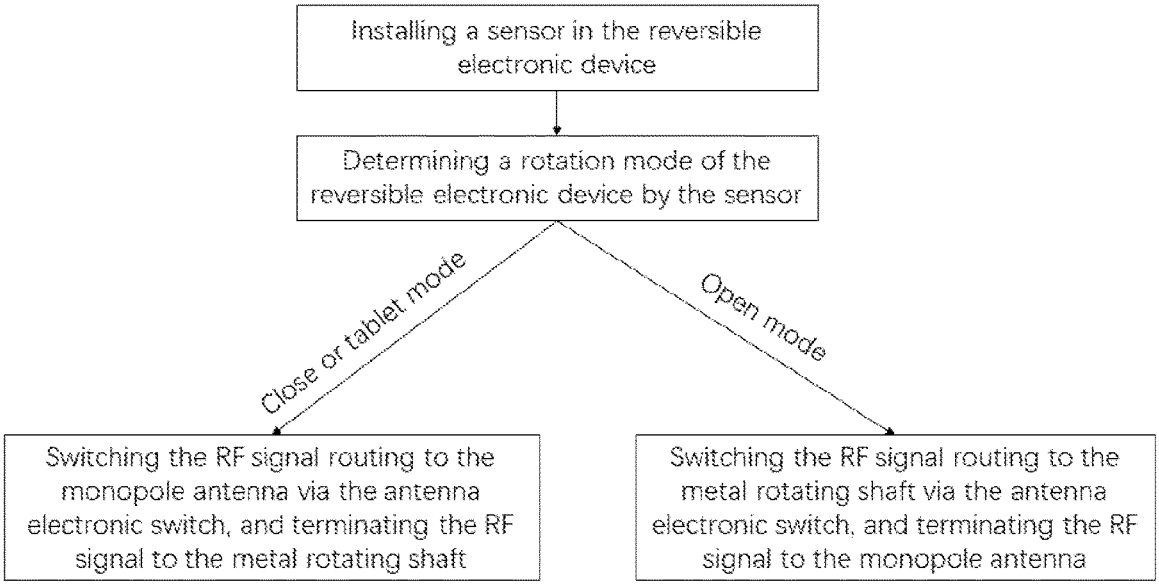
FIG. 49A shows a flow chart regarding how the antenna electronic switch selects the RF signal path using sensors of an ultra-wideband antenna for a reversible electronic device according to embodiment 9.

FIG. 49A is a flow chart showing a method for triggering the switch state of the above-mentioned ultra-wideband antenna by using a sensor, including the following: installing a sensor in the reversible electronic device; determining a rotation mode of the reversible electronic device by the sensor; if the sensor detects that the rotation mode of the reversible electronic device is close or tablet mode, switching the RF signal routing to the monopole antenna 40 via the antenna electronic switch 39, and terminating the RF signal to the hinge 12; if the sensor detects that the rotation mode of the reversible electronic device is open mode, switching the RF signal routing to the hinge 12 via the antenna electronic switch 39, and terminating the RF signal to the monopole antenna 40. The sensor may be a proximity sensor, a light sensor or the like. For the better antenna performance, the below condition may be predetermined: when the reversible electronic device is in close (theta=0 degree) or tablet (theta=360 degree) mode, the RF signal path will be set to be routed to RF signal to monopole antenna and terminated to hinge 12 path; when the reversible electronic device is in the normal open mode, the RF signal path will be routed to hinge 12 and terminated to the monopole antenna 40.

Figure 49B:
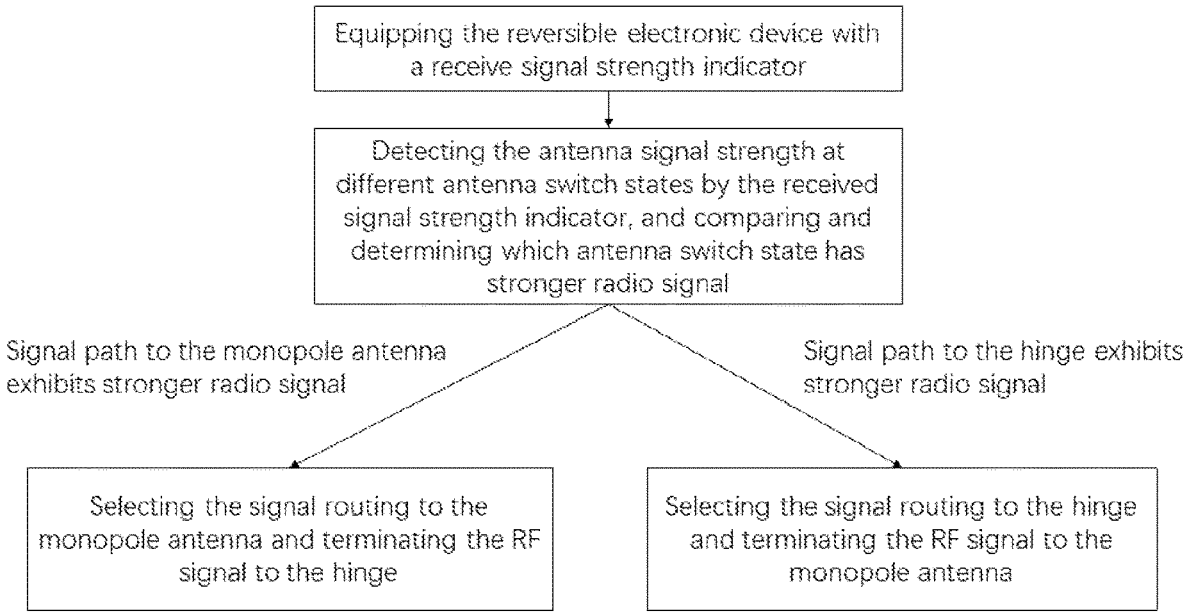
FIG. 49B shows a flow chart regarding how the antenna electronic switch selects the RF signal path using a Received Signal Strength Indicator of an ultra-wideband antenna for a reversible electronic device according to embodiment 9.

FIG. 49B is a flow chart showing a method for triggering the switch state of the above-mentioned ultra-wideband antenna by using a received signal strength indicator (RSSI), including the following: equipping the reversible electronic device with a received signal strength indicator; detecting the antenna signal strength at different antenna switch states by the received signal strength indicator, and comparing and determining which antenna switch state has stronger radio signal; if the signal path to the monopole antenna 40 exhibits stronger radio signal, selecting the signal routing to the monopole antenna 40 and terminating the RF signal to the hinge 12; if the signal path to the hinge 12 exhibits stronger radio signal, selecting the signal routing to the hinge 12 and terminating the RF signal to the monopole antenna 40.

Figure 50A:
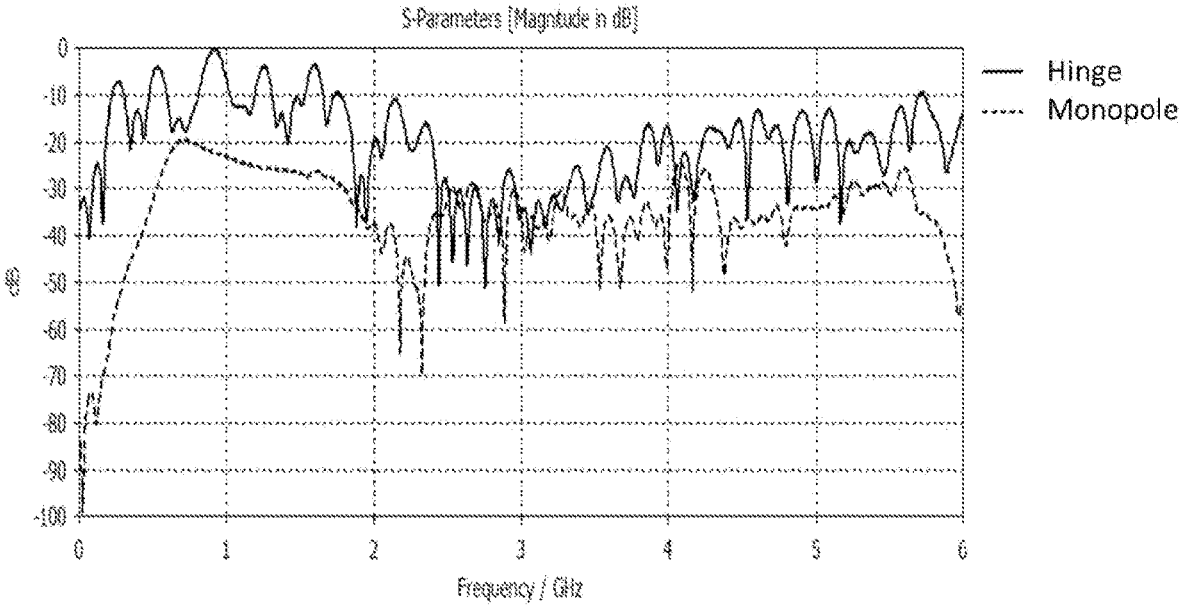
FIG. 50A is a simulated isolation comparison diagram between hinge-hinge and monopole-monopole antennas in embodiment 9.
Figure 50B:
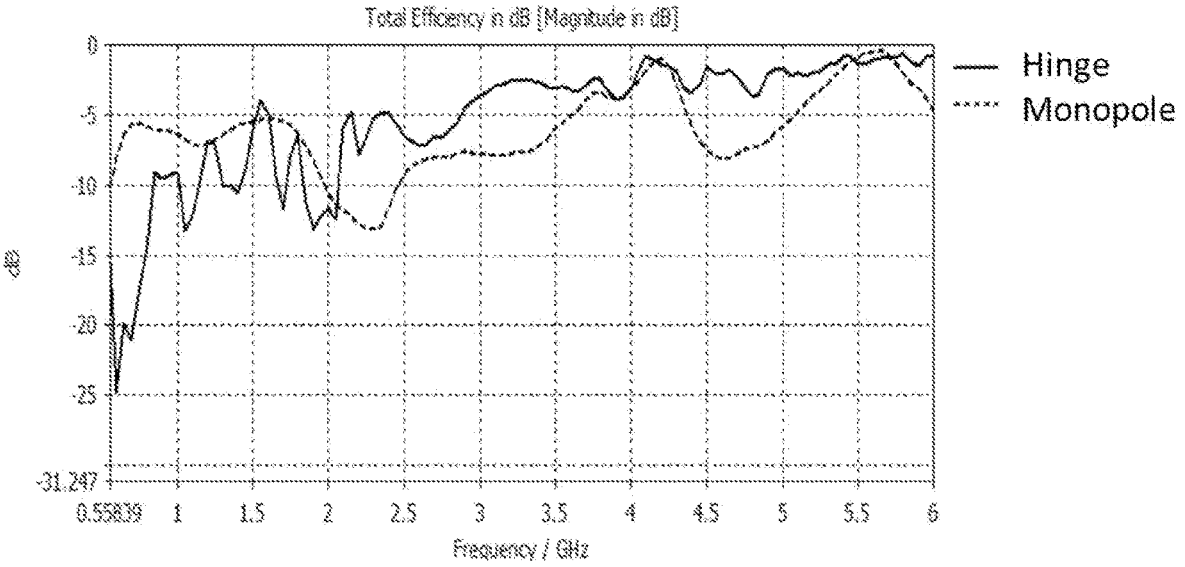
FIG. 50B is a simulated efficiency comparison diagram between hinge and monopole antenna in embodiment 9.

The design of this Embodiment helps to improve the isolation and antenna performance of the ultra-wideband antennas when the reversible electronic device is in close or tablet mode. FIG. 50A shows the isolation performance comparison between hinge-hinge antennas and monopole-monopole antennas when the reversible electronic device is in the close mode. The hinge-hinge antennas herein refer to the left-side hinge antenna and the right-side hinge antenna in a reversible electronic device. The monopole-monopole antennas refer to the monopole antennas both in the near left-side hinge and in the near right-side hinge. From FIG. 50A, it can be observed that the isolation between monopole-monopole antennas is lower than −20 dB, which is better than that of the hinge-hinge antennas. FIG. 50B shows antenna efficiency comparison between hinge antenna and monopole antenna. It can be observed from FIG. 50B that the efficiency of monopole antenna is better than that of the hinge antenna especially up to 2 GHz due to the fact that isolation is improved, while for higher frequencies, although the efficiency of the monopole antenna is not better but it has sufficient good performance.

The above description and specific embodiments are only the applications of the present disclosure in the design of WWAN, MIMO, and WLAN antennas. According to needs, the present disclosure may also be applied to the antenna design of BT, Navigation, UWB, WiFi 6 and more frequency bands in the future. The size of the upper and lower halves, the shape of the hinge, the positions of the signal source access point and the electrical connection point, and the feeding form are not limited in the present disclosure. All other variations based on the working principle of the present disclosure shall fall within the protection scope of the present disclosure.

All the above examples are shown as all-metal bodies. However, the body design in the present disclosure is not limited to the all-metal. As long as the basic composition requirement of the present disclosure is met, other materials are also applicable, such as a plastic body attached with metal copper foil, aluminum foil or the like. Similarly, the present disclosure is described above by taking a notebook computer as an example, but it is not limited to a notebook computer. Other electronic devices with similar structures, such as electronic dictionaries and multi-screen foldable mobile phones, may all adopt the antenna design of the present disclosure.

In summary, the present disclosure provides an ultra-wideband antenna for a reversible electronic device. Without additional slotting or slitting, the structural characteristics of the hinge area of the reversible electronic device are skillfully used. By setting a U-shaped gapped groove, the design of the ultra-wideband antenna in a narrow space is realized. The working frequency bands cover all 2G, 3G, 4G, 5G (FR1), BT, Navigation, and Wi-Fi communication frequency bands. In addition, while realizing the design of ultra-wideband antennas, the design of multiple antennas is allowed to be further optimized, and the isolation between multiple antennas is better than −10 dB, which basically satisfies the performance target of the antennas. Therefore, the present disclosure effectively overcomes various shortcomings in the traditional technology and has high industrial utilization value.

The above-described embodiments are merely illustrative of the principles of the disclosure and its effects, and are not intended to limit the disclosure. Modifications or variations of the above-described embodiments may be made by those skilled in the art without departing from the spirit and scope of the disclosure. Therefore, all equivalent modifications or changes made by those who have common knowledge in the art without departing from the spirit and technical concept disclosed by the present disclosure shall be still covered by the claims of the present disclosure.

What is claimed is:

1. An ultra-wideband antenna for a reversible electronic device, comprising at least:

an upper half and a lower half;

a hinge having a first end and a second end opposite to the first end; the hinge is connected with the upper half through the first end, and is connected with the lower half through the second end;

a first RF signal source, loaded on the hinge;

an electrical connection structure, placed on one side of the first RF signal source and electrically connected with the upper half and the lower half;

a gapped groove, extending inwardly to the electrical connection structure along an outer side of the upper half and an outer side of the lower half; the hinge is spanned on the gapped groove;

wherein the hinge excites the gapped groove to form a first ultra-wideband antenna;

wherein the first RF signal source is connected with the first end of the hinge, the first end of the hinge is non-electrically connected with the upper half, and the second end of the hinge is electrically connected with the lower half; or the first RF signal source is connected with the second end of the hinge, the second end of the hinge is non-electrically connected with the lower half, and the first end of the hinge is electrically connected with the upper half; or the first RF signal source is connected with an interior of the hinge, the first end of the hinge is electrically connected with the upper half, the second end of the hinge is electrically connected with the lower half.

2. The ultra-wideband antenna for a reversible electronic device according to claim 1, wherein the electrical connection structure is connected with an interior of the hinge; the first end of the hinge is electrically connected with the upper half; the second end of the hinge is electrically connected with the lower half.

3. The ultra-wideband antenna for a reversible electronic device according to claim 1, wherein connection positions of the hinge with the upper half and the lower half are adjustable, and/or a size and shape of the hinge is adjustable.

4. The ultra-wideband antenna for a reversible electronic device according to claim 1, wherein the electrical connection structure is a circumferentially enclosed hollow metal layer, and the hollow metal layer internally wraps a communication signal line between the upper half and the lower half.

5. The ultra-wideband antenna for a reversible electronic device according to claim 1, wherein the electrical connection structure is in a form of flexible printed circuit (FPC) integrated with a communication signal line and a ground.

6. The ultra-wideband antenna for a reversible electronic device according to claim 1, further comprising a first type of first excitation unit; the first type of first excitation unit is placed in a slot formed by the upper half, the lower half, the hinge and the electrical connection structure; the first type of first excitation unit excites the slot to form a second ultra-wideband antenna, and an excitation mode of the first type of first excitation unit is direct excitation or coupling excitation.

7. The ultra-wideband antenna for a reversible electronic device according to claim 1, further comprising a second type of first excitation unit, wherein the second type of first excitation unit includes an antenna trace, an excitation component, and a signal source; the second type of first excitation unit is placed in a slot formed by the upper half, the lower half, the hinge and the electrical connection structure; the second type of first excitation unit excites the slot to form a second ultra-wideband antenna, and an excitation mode of the second type of first excitation unit is coupling excitation.

8. The ultra-wideband antenna for a reversible electronic device according to claim 1, further comprising a third type of first excitation unit, wherein the third type of first excitation unit includes an excitation component, and a signal source; the third type of first excitation unit is placed in a slot formed by the upper half, the lower half, the hinge and the electrical connection structure; the third type of first excitation unit excites the slot to form a second ultra-wideband antenna, and an excitation mode of the third type of first excitation unit is direct excitation.

9. The ultra-wideband antenna for a reversible electronic device according to claim 6, further comprising a balun structure connecting to the first type of first excitation unit.

10. The ultra-wideband antenna for a reversible electronic device according to claim 6, further comprising a dipole antenna, the dipole antenna is placed in the slot and is placed horizontally along a length of the slot, and the first type of first excitation unit is placed perpendicularly and orthogonally with the dipole antenna.

11. The ultra-wideband antenna for a reversible electronic device according to claim 10, wherein an excitation mode of the dipole antenna is coupling excitation; the dipole antenna includes a signal source, an excitation component connected with the signal source the dipole antenna, and a dipole antenna trace; the excitation component couples a signal of the signal source of the dipole antenna to the dipole antenna trace, such that the dipole antenna trace works in a dipole-like antenna mode.

12. The ultra-wideband antenna for a reversible electronic device according to claim 7, further comprising a dipole antenna, the dipole antenna is placed in the slot and is placed horizontally along a length of the slot, and the second type of first excitation unit is placed perpendicularly and orthogonally with the dipole antenna.

13. The ultra-wideband antenna for a reversible electronic device according to claim 12, wherein an excitation mode of the dipole antenna is coupling excitation; the dipole antenna includes a signal source, an excitation component connected with the signal source of the dipole antenna, and a dipole antenna trace; the excitation component couples a signal of the signal source of the dipole antenna to the dipole antenna trace, such that the dipole antenna trace works in a dipole-like antenna mode.

14. The ultra-wideband antenna for a reversible electronic device according to claim 1, further comprising a monopole antenna, wherein the monopole antenna is placed in a slot formed by the upper half, the lower half, the hinge and the electrical connection structure.

15. The ultra-wideband antenna for a reversible electronic device according to claim 14, further comprising an antenna electronic switch having an RF input end, a first RF output end and a second RF output end, wherein the RF input end of the antenna electronic switch is connected with the first RF signal source, and the first RF output end and the second RF output end are connected with the monopole antenna and the hinge, respectively.

16. The ultra-wideband antenna for a reversible electronic device according to claim 15, further comprising a sensor, wherein the sensor detects a rotation mode of the reversible electronic device, such that the antenna electronic switch switches an RF signal path to the monopole antenna or the hinge based on the rotation mode detected by the sensor.

17. The ultra-wideband antenna for a reversible electronic device according to claim 15, further comprising a received signal strength indicator, wherein the received signal strength indicator detects antenna signal strength at different RF signal path, such that the antenna electronic switch selects a signal routing to the monopole antenna or the hinge based on better signal strength detected by the received signal strength indicator.

18. The ultra-wideband antenna for a reversible electronic device according to claim 1, wherein an antenna bracket is provided between the upper half and the lower half, and the electrical connection structure is a metal trace provided on the antenna bracket; a part of the metal trace is a circumferentially enclosed hollow metal layer, and a rest of the metal trace is a solid metal trace, and the hollow metal layer internally wraps a communication signal line between the upper half and the lower half; or, the metal trace is a circumferentially enclosed hollow metal layer, and the hollow metal layer internally wraps a communication signal line between the upper half and the lower half.

19. The ultra-wideband antenna for a reversible electronic device according to claim 1, wherein an antenna bracket is provided between the upper half and the lower half, and the electrical connection structure is a metal trace provided on the antenna bracket; the metal trace includes a long side extending in a horizontal direction and a short side extending in a vertical direction; the long side is electrically connected with the lower half, and the short side is electrically connected with the upper half; at least one antenna isolation ground structure is provided in the vertical direction; one end of the antenna isolation ground structure is electrically connected with the long side of the metal trace, and the other end of the antenna isolation ground structure is electrically connected with the upper half; at least two antenna slits are formed between the adjacent short side of the metal trace and the antenna isolation ground structure and between adjacent antenna isolation ground structures; a second excitation unit which uses direct excitation or coupling excitation is placed in each of the antenna slits; the second excitation unit excites the antenna slits to form at least two slit antennas.

20. The ultra-wideband antenna for a reversible electronic device according to claim 19, wherein the long side, the short side, and the antenna isolation ground structure are circumferentially enclosed hollow metal layers; the hollow metal layer internally wraps the communication signal line between the upper half and the lower half; or, the communication signal line between the upper half and the lower half is wired along part or all of a surface of the long side, the short side, and/or the antenna isolation ground structure.

21. The ultra-wideband antenna for a reversible electronic device according to claim 20, wherein the communication signal line includes a ground wire and a core wire; the long side, the short side and the antenna isolation ground structure at corresponding positions of a wiring of the communication signal line are the ground wires.

22. The ultra-wideband antenna for a reversible electronic device according to claim 19, wherein at least one antenna isolation ground structure is provided between adjacent antenna slits, to improve an isolation between the slit antennas.

23. The ultra-wideband antenna for a reversible electronic device according to claim 19, wherein the long side of the metal trace is an electrically continuous long side or a non-electrically continuous long side.

24. The ultra-wideband antenna for a reversible electronic device according to claim 19, wherein an opening is provided on the antenna bracket, and the metal trace and the antenna isolation ground structure are attached to an inner wall of the opening; the antenna isolation ground structure attached to the inner wall of the opening forms a three-dimensional antenna isolation ground structure, and the metal trace attached to the inner wall of the opening forms a two-dimensional or three-dimensional metal trace.

25. The ultra-wideband antenna for a reversible electronic device according to claim 19, further comprising a slit antenna; the slit antenna includes a long slit formed between the long side extending in the horizontal direction and the lower half, and a third excitation unit placed in the long slit; the third excitation unit excites the long slit to form the slit antenna; an excitation mode of the third excitation unit is direct excitation or coupling excitation.

26. The ultra-wideband antenna for a reversible electronic device according to claim 25, further comprising at least one metal connecting wire and at least two third excitation units; the metal connecting wire and the third excitation units are placed between the upper half and the lower half; one end of the metal connecting wire is connected with the upper half, and the other end of the metal connecting wire is connected with the lower half; all the metal connecting wires divide the long slit into at least two slits; at least two third excitation units are placed in each of the slits, respectively; the third excitation unit excites the slit where it is located to form a slit antenna.

27. The ultra-wideband antenna for a reversible electronic device according to claim 1, further comprising at least one metal connecting wire and a fourth excitation unit; the metal connecting wire and the fourth excitation unit are placed between the upper half and the lower half; one end of the metal connecting wire is connected with the upper half, and the other end of the metal connecting wire is connected with the lower half; at least one slit is formed between the adjacent metal connecting wire and the electrical connection structure, and between two adjacent metal connecting wires; the fourth excitation unit is placed in each of the slits; the fourth excitation unit excites the slit where it is located to form a slit antenna.

28. The ultra-wideband antenna for a reversible electronic device according to claim 11, wherein the first type of first excitation unit or the dipole antenna trace of the dipole antenna serves as a sensing pad of a distance sensor.

29. The ultra-wideband antenna for a reversible electronic device according to claim 13, wherein the antenna trace of the second type of first excitation unit or the dipole antenna trace of the dipole antenna serves as a sensing pad of a distance sensor.

30. The ultra-wideband antenna for a reversible electronic device according to claim 26, wherein at least one of an excitation component of the second excitation unit and an excitation component of the third excitation unit serves as a sensing pad of a distance sensor.

31. The ultra-wideband antenna for a reversible electronic device according to claim 27, wherein an excitation component of the fourth excitation unit serves as a sensing pad of a distance sensor.

32. The ultra-wideband antenna for a reversible electronic device according to claim 14, wherein the monopole antenna serves as a sensing pad of a distance sensor.

33. The ultra-wideband antenna for a reversible electronic device according to claim 8, wherein the third type of first excitation unit serves as a sensing pad of a distance sensor.

* * * * *